United States Patent [19]

Peterson

[11] 4,183,295

[45] Jan. 15, 1980

[54] TRASH COMPACTOR WITH COVER MOUNTED PACKING BLADE

[76] Inventor: Robert A. Peterson, 16521 Redwood Dr., Cerritos, Calif. 90701

[21] Appl. No.: 890,720

[22] Filed: Mar. 20, 1978

[51] Int. Cl.[2] ..... B30B 1/08; B30B 15/06

[52] U.S. Cl. ..... 100/53; 100/226; 100/233; 100/269 R; 100/295; 137/625.65; 292/120

[58] Field of Search ..... 100/233, 295, 53, 269 R, 100/240, 245, 90, 229 A, 226; 292/120, 139; 137/625.65

[56] References Cited

U.S. PATENT DOCUMENTS

| | | | |
|---|---|---|---|
| 3,835,767 | 9/1974 | Peterson | 100/233 |
| 3,835,769 | 9/1974 | Peterson | 100/295 X |
| 3,874,282 | 4/1975 | Oouchi | 100/229 A |
| 3,961,573 | 6/1976 | Schmidt | 100/233 |
| 4,024,806 | 5/1977 | Weeks | 100/229 A |
| 4,070,962 | 1/1978 | Peterson | 100/233 |

*Primary Examiner*—Billy J. Wilhite

*Attorney, Agent, or Firm*—Frederick E. Mueller

[57] ABSTRACT

A refuse compactor having a packing blade hinged under the cover of a container and movable through an automatic refuse packing cycle involving initial downward extension of the blade through a packing stroke by atmospheric pressure and gravity, to effectively compact refuse within the container, and final upward return of the blade by air pressure to a normal retracted position against the underside of the cover each time the cover is locked in closed position. The compactor embodies a safety feature whereby the packing blade is securely latched in the retracted position and positively inactivated against extension through its packing stroke except when the compactor cover is locked in closed position.

37 Claims, 19 Drawing Figures

Fig. 6a
Fig. 3a
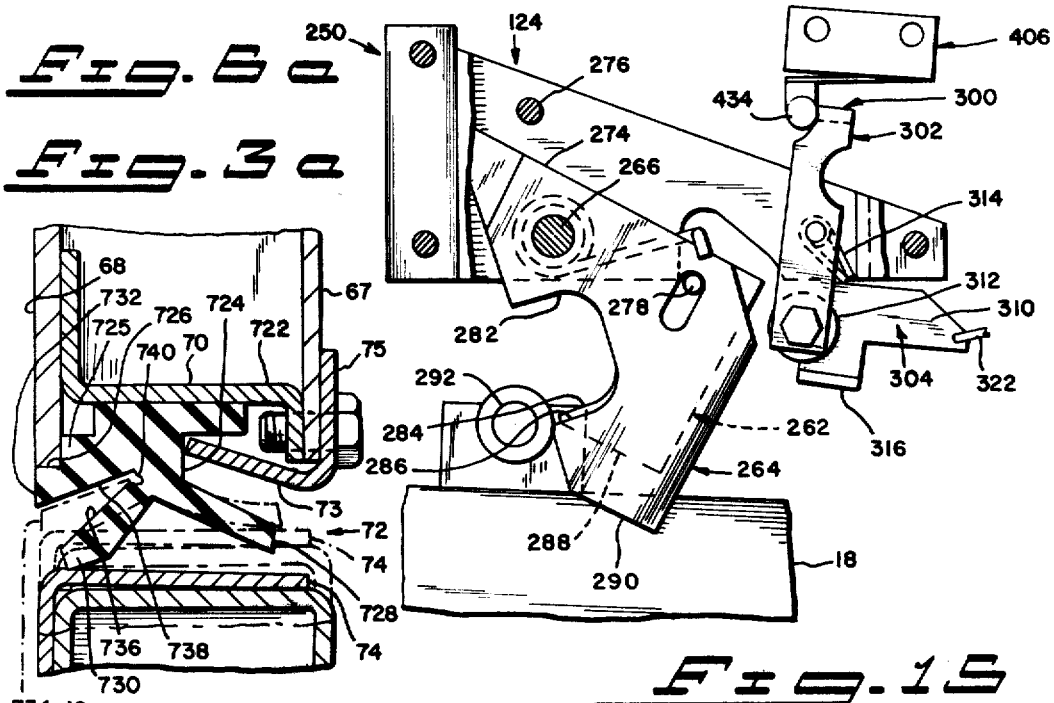
Fig. 15
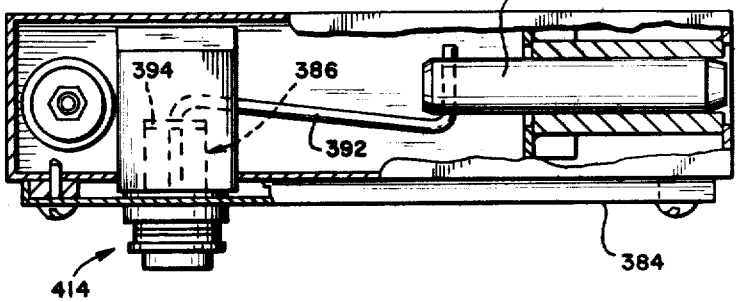
Fig. 16
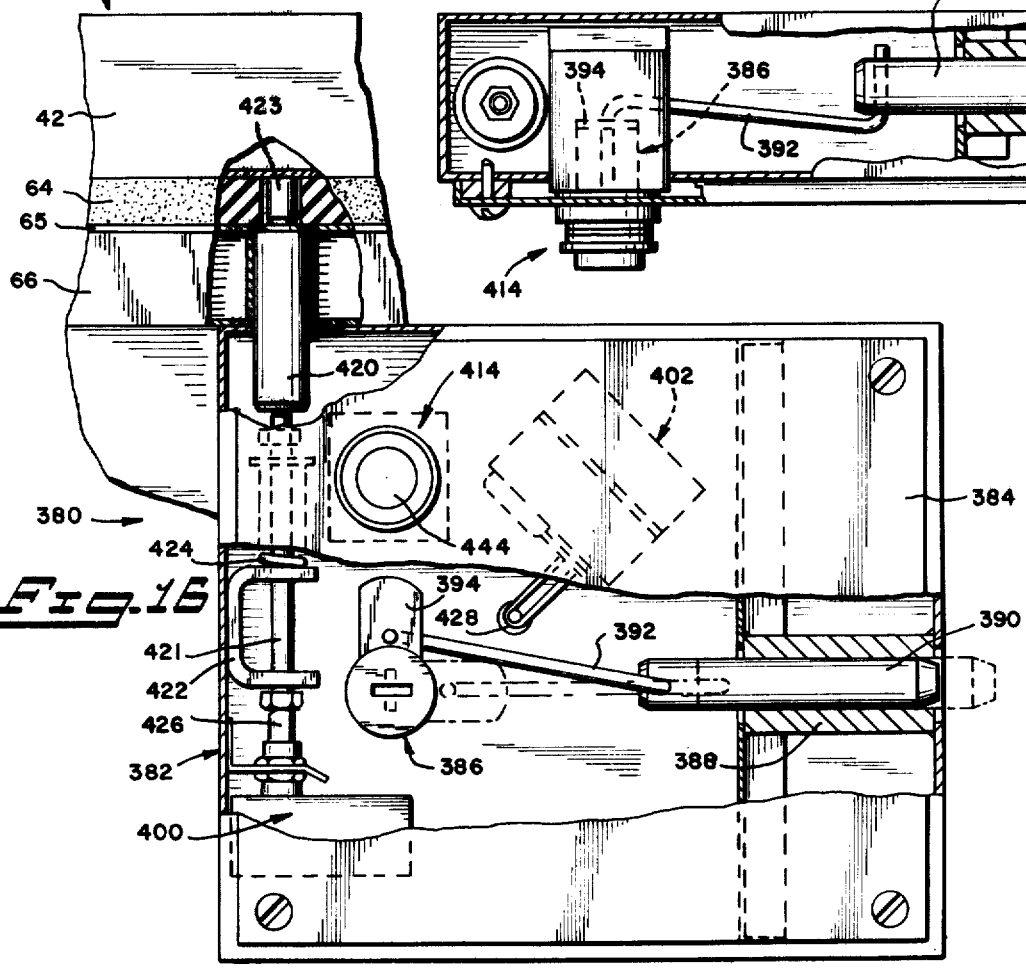

TRASH COMPACTOR WITH COVER MOUNTED PACKING BLADE

BACKGROUND OF THE INVENTION

Field of the Invention

This invention relates generally to refuse handling equipment and more particularly to an improved refuse compactor.

At the present time, it is common practice to collect refuse at apartment complexes, industrial facilities, shopping centers, and the like in large refuse bins or containers which lack any means for compressing or compacting the container contents. As a consequence, the existing refuse containers are characterized by highly inefficient refuse containment. The container must thus be emptied of their loose refuse at frequent intervals by refuse collection and compaction vehicles which transport the refuse to disposal sites.

For this reason, it has been proposed to provide refuse containers with self-contained means for compressing or compacting the refuse in the containers. Examples of such refuse compactors are described in my prior U.S. Pat. Nos. 3,835,767; 3,835,769, and 4,070,962.

Simply stated a self-contained refuse compactor comprises a container with a cover which may be opened to place refuse in and empty refuse from the container, a packing element in the container, and means for driving the packing element through a packing cycle to compress or compact refuse in the container. A feature of the compactors in my above mentioned prior patents resides in the fact that the packing element is movable through its refuse packing stroke by atmospheric pressure. In the compactor of my U.S. Pat. No. 4,070,962, the packing element is a pivotal packing blade hinged along its lower edge to the bottom wall of the container to swing on a horizontal axis in the fore and aft direction of the container for compressing refuse between the blade and the front and/or rear wall of the container.

SUMMARY OF THE INVENTION

This invention provides an improved refuse compactor characterized by enhanced compacting efficiency and operating safety.

The present compactor has a packing blade hinged immediately under and, preferably, directly to the cover of the container. This packing blade or plate constitutes one entire side of the container space when the cover is closed. When retracted, the pressure plate is locked against the underside of the cover and swings upwardly with the cover when the latter is opened to place refuse in and empty refuse from the container.

During each packing cycle, the container is evacuated by packing blade operating means to cause downward swinging of the packing blade through the container by atmospheric pressure and gravity to compress refuse between the blade and the container walls. The operating means then pressurizes the container to return the packing blade upwardly to its retracted position against the underside of the cover.

Another feature of the invention is concerned with the operating safety of the compactor. According to this feature, latch mechanisms are provided for securely locking the packing blade in its retracted position and for locking the cover in its closed position. Associated with these latch mechanisms and with the packing blade operating means is an electrical control circuit including a key lock. The packing blade latch mechanism is conditioned to release the packing blade for downward extension through its packing stroke and the blade operating means is conditioned to evacuate the refuse container for effecting this compression stroke of the blade by rotation of the key lock to a start/lock position only when the compactor cover is latched closed. Under these conditions, rotation of the key lock to its start/lock position locks the cover latch mechanism against release and initiates a refuse packing cycle of the packing blade.

The key is removable from the compactor key lock only when the latter occupies its start/lock position. Since rotation of the lock to this position triggers a packing cycle of the compactor, the refuse in the compactor is compressed after each time the cover is opened to place refuse in the compactor and then locked in closed position. This periodic compression of the compactor contents substantially increases the compacting efficiency of the compactor.

The packing blade latch means embodies a safety interlock operated by the compactor control system. This interlock prevents release of the latch means until the compactor cover is locked in closed position. The latch means also embodies a relatively stiff spring for retaining the latch means in latching engagement with the packing blade even after retraction of the safety interlock. The strength of this spring is such that the latch means releases the packing blade only upon evacuating air from the refuse container to produce an atmospheric pressure force on the blade for driving the latter downwardly through its refuse packing stroke.

Other features of the invention are concerned with the compactor cover and packing blade seals, a unique valve assembly for the blade operating means having valve members which are operable to open position by pressure forces so as to render the valve immune to sticking or freezing closed in cold weather, and with various other features of construction of the compactor which uniquely adapt the latter to its intended purposes.

BRIEF DESCRIPTION OF THE DRAWINGS

FIG. 3*a* is a section, on a larger scale, of the cover end wall seal means of FIG. 3;

FIG. 6*a* is a view similar to FIG. 6 illustrating the packing blade latch means in blade releasing position;

FIG. 15 is an enlarged horizontal section through a key lock unit embodied in the compactor; and FIG. 16 is a front view of the key lock unit in FIG. 15 with a portion broken away for the sake of clarity.

PREFERRED EMBODIMENT

Figure 1:
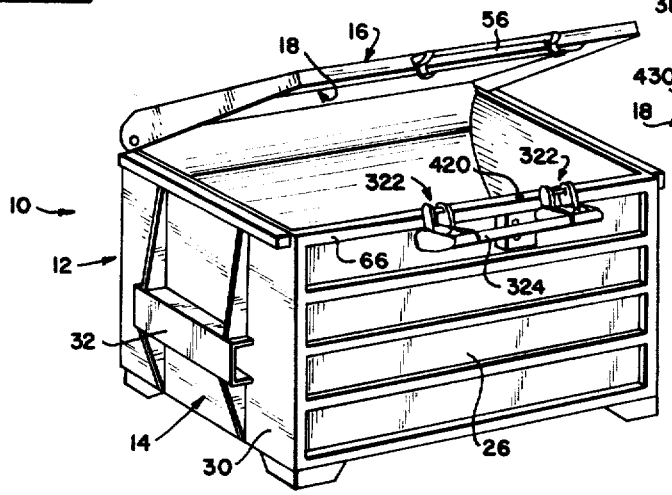
FIG. 1 is a perspective view of a refuse compactor according to the invention with the compactor cover open.

In general terms, the refuse compactor 10 comprises a container 12 including a body 14 defining a refuse receiving space 15. The container has a hinged cover 16 for closing the top opening of the body. A refuse packing blade 18 is hinged along one edge to the underside of the cover 16. Operating means 20 are provided for moving the packing blade 18 through a refuse packing cycle.

Figure 2A:
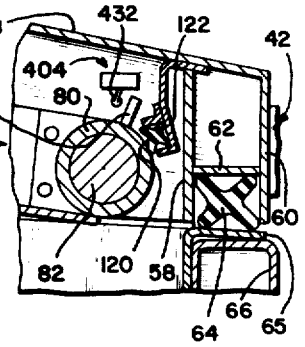
FIG. 2*a* is an enlarged fragmentary section illustrating a packing blade seal.
Figure 2:
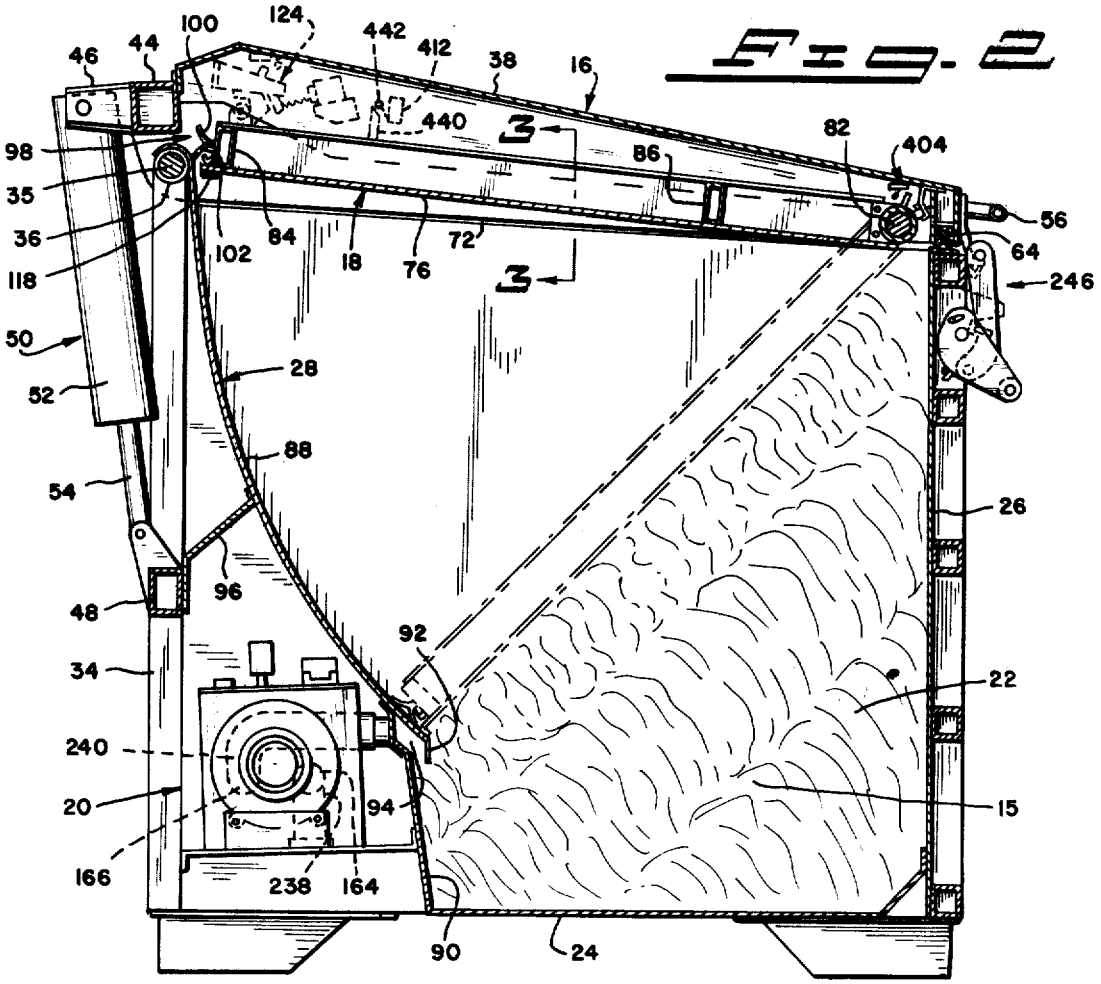
FIG. 2 is an enlarged fore and aft vertical section through the compactor in FIG. 1.

Packing blade 18 has a normal retracted position against the underside of the cover 16, as shown in solid lines in FIG. 2. During its refuse packing cycle, the packing blade initially swings or extends downwardly through the body 14 toward its fully extended position, shown in broken lines in FIG. 2, to compress refuse 22 between the blade and the container body walls. the packing blade then returns or retracts upwardly to the underside of the cover 16. As will be explained in more detail, the compactor embodies a safety feature, whereby the packing blade 18 can be operated through its cycle only when the cover 16 is locked in closed position. Also, the blade is operated through a cycle automatically in response to closing and locking of the compactor cover to improve compacting efficiency.

More specifically, the body 14 of the compactor has a generally rectangular box-like shape, including a bottom wall 24 and upstanding side walls about the edges of the bottom wall defining and bounding a refuse space 15 within the container. These side walls include a front wall 26, a rear wall 28, and end walls 30. Refuse space 15 opens through the top of the body 14 to permit placement of loose refuse in and emptying of compacted refuse from the container. The body is fabricated from sheet steel and is reinforced, as shown, so that its walls are relatively rigid. Welded to the end walls 30 are channels 32 (only one visible) for receiving the forks of a fork lift on a refuse collection vehicle (not shown) to invert the container for dumping.

The compactor cover 16 is also fabricated from sheet steel so as to be relatively rigid. The cover is hinged along its rear edge to the upper ends of rigid upstanding posts 34 at the rear of the container body 14 for swinging between its open (FIG. 1) and closed (FIG. 2) positions relative to the container body. The cover hinge means comprises bearing sleeves 36 fixed at opposite ends of and along the rear edge of the cover and mounted in stub journals 35 welded to the upper ends of the posts 34.

Cover 16 has a top wall 38, depending double wall flanges 40 (FIG. 3) along the ends of the top wall, and a depending double wall flange 42 (FIG. 2*a*) along the front edge of the top wall. Extending along the rear edge of the cover is a rigid box channel or beam 44. Welded to the ends of and projecting rearwardly from this beam are arms 46. A second box channel or beam 48 extends between and is welded to the rear container posts 34 a distance below the cover.

Pivotally connected between the outer ends of the cover arms 46 and the container beam 48 are spring counterbalance units 50 for the cover 16. Each counterbalance unit has an upper barrel 52 pivotally connected at its upper end to a cover arm 46 and containing a movable spring loaded plunger 54. This plunger is pivotally connected at its lower end to the lower beam 48. The plunger is biased into the barrel by a spring (not shown) contained in the barrel. Counterbalance units 50 bias the cover 16 toward and normally retain the cover in its open position of FIG. 1. Along the front edge of the cover is a handlebar 56 by which the cover may be closed against the spring bias of the counterbalance units.

When closed, the cover 16 is sealed along its front and end edges to the container body 14. To this end, the two walls 58, 60 (FIG. 2*a*) of the front cover flange 42 are bridged by a cross wall 62 which forms with the side walls a downwardly opening channel receiving a resilient seal 64 of cruciform cross-section. When the cover 16 is closed, the two lower divergent flanges of this cruciform seal seat against a container wall flange 65 along the upper edge of the front container body wall 26 to seal the front edge of the cover to the front container wall.

Similarly, the two walls 67, 68 (FIG. 3) of each cover end flange 40 are bridged by a cross wall 70. This cross wall forms with the side walls a downwardly opening channel receiving a seal 72 of irregularly shaped cross-section, which will later be described in detail. When the cover 16 is closed, the lower leg of each cover end seal 72 seats against a container wall flange 74 along the upper edge of the respective container body end wall 30.

Figure 3:
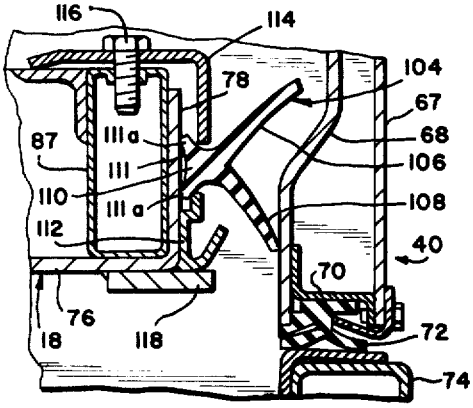
FIG. 3 is an enlarged section taken on line 3—3 in FIG. 2.
Figure 5:
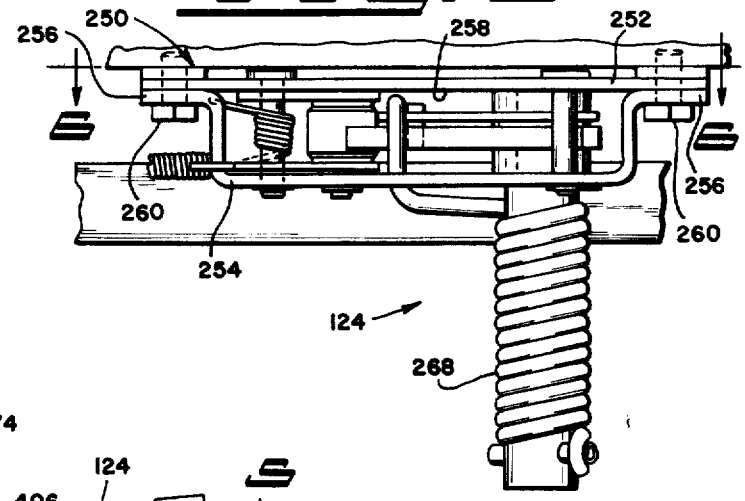
FIG. 5 is an enlarged section taken on line 5—5 in FIG. 4.

The compactor blade assembly 18 comprises a lower, relatively rigid sheet metal plate 76 with upstanding flanges 78 along its end and rear edges, as in FIG. 3. Rigidly joined to the upper side of the plate 76 along opposite ends of its front edge are stub shafts 82 that are rotatably mounted in bearing sleeves 80 on the underside of the cover 16 adjacent and parallel to its front flange 42.

Sleeves 80 and journals 82 form a hinge for the packing blade 18. This hinge pivotally supports the packing blade on the cover 16 for swinging between its solid line retracted and broken line extended positions of FIG. 2 when the cover is closed. Reinforcing box channels or beams 84, 86, 87 are rigidly joined to and extend across the top side of the blade plate 76 along its rear edge, across the plate at an intermediate position, and along the ends of the plate respectively.

The rear wall 28 of the refuse body 14 has upper and lower portions 88, 90. The upper wall portion 88 is cylindrically curved about an axis which coincides with the hinge axis of the packing blade 18 when the cover 16 is closed. The upper edge of this upper wall portion curves around and is fixed to a cross tube extending between the pair of journals 35. The lower edge of the upper wall portion 88 terminates in a downturned flange 92 located a distance above the container bottom wall 24.

The lower rear container wall portion 90 extends upwardly from the bottom container wall 24 and joins the lower wall portion 88 above and to the rear of the flange 92 to form therebetween an air passage 94. The purpose of this air passage will be explained presently. The upper wall portion 88 is braced at 96.

The packing blade 18 is sealed about all of its edges to the compactor container 12. To this end, the radius of curvature of the rear container wall portion 88 is only slightly greater than the effective radial dimension of the blade. Accordingly, only a narrow gap exists between the rear blade edge and the rear wall portion. The rear packing blade edge is sealed to the rear container wall portion 88 by a resilient seal 98 (FIG. 2). This seal is secured to the rear flange 78 of the blade and has divergent sealing and wiping flanges 100, 102, engaging the rear wall portion, all in a manner to be explained presently.

The length of the packing blade 18 endwise of the refuse container 12 is only slightly less than the container length. Accordingly, only narrow gaps exist between the container end walls 30 and the blade ends. Along the ends of the packing blade are resilient seals 104 (FIG. 3—only one shown). These seals seal the blade to the cover end flanges 40 when the blade is retracted and to the container end walls during extension and retraction of the blade through its refuse packing cycle. End seals 104 are identical to the rear edge seal 98 and have resilient sealing and wiping flanges 106, 108, respectively.

The packing blade seals 98, 104 have enlarged Y-base portions 110 with a shallow V-shaped face 111 defining a pair of parallel sharp edges 111*a* seating and sealing against the upturned end flanges 78 of the packing blade. Secured to these end flanges, below the seals 98, 104, are strips 112 defining channels receiving the lower longitudinal edges or lips of the seal base portions 110, as shown. Engaging over the upper longitudinal edges of the seal base portions are clamp bars 114 of generally L-cross-section. These clamp bars are secured by clamp screws 116 to the packing blade beams 84,87 and coact with the channel strips 114 to secure the seals 98, 104 to the packing blade 18. Rigid scraper bars 118 are secured to and project beyond the ends of the packing blade below the end seals 104 for reasons to be explained later.

End seals 104 are sized to bridge the gaps between the ends of the packing blade 18 and the refuse container end walls 30 and cover end walls 40. The end seal flanges 106, 108 engage and are slightly deflected by the end walls and flanges except in the fully retracted position of the packing blade shown in FIG. 3. The inner walls 68 of the cover end flanges have outwardly offset upper portions to provide clearance for the sealing flanges 106 in the fully retracted position of the packing blade. The sealing flanges are thus totally free and undeflected in the retracted position of the blade. This prevents the sealing flanges from acquiring a permanent set which would degrade their sealing efficiency.

The rear packing blade seal 98 is sized to bridge the gap between the rear blade edge and the curved rear container wall portion 88. The sealing flanges 100, 102 of seal 98 engage and are slightly deflected by the rear wall portion 88 except in the fully retracted position of the packing blade. In this retracted position, the upper sealing flange 100 is located above the upper curved edge of the rear container wall. The upper sealing flange is thus totally free and undeflected in this retracted position to prevent the flange from acquiring a permanent set. When cover 16 is opened and closed the flange 102 of the seal remains in wiping contact with reversely curved upper end of container wall 88 to prevent entry of refuse behind the pressure plate 18.

The front edge of the packing blade 18 is sealed to the cover 16 by a seal 120 shown in FIG. 2*a*. This seal comprises a sealing strip of cruciform cross-section fixed within a channel bracket 122 mounted on the front flange 42. Seal 120 extends along the hinged front edge of the blade and has two resilient sealing flanges which bear against a cylindrical front edge of the blade.

It will now be understood that during rotation of the packing blade 18 between its retracted and extended positions, the sealing flanges 100, 102 of the rear blade seal 98 slide along the rear curved container wall portion 88. The sealing flanges 106, 108 of the blade end seals 104 slide cover the cover end flanges 40, cover end seals 72, and the container end walls 30. Airtight seals are thereby maintained between the packing blade and the container end and rear walls under both negative and positive pressures. The front seal 120 similarly maintains an airtight seal along the front edge of the packing blade during both extension and retraction of the blade.

During downward extension of the packing blade 18 through its refuse packing stroke, the wiping flanges 102, 108 of its rear and end seals 98, 104 precede their sealing flanges 100, 106 to wipe the inner container surfaces ahead of the sealing flanges. This wiping action both improves the sealing efficiency and prolongs the useful life of the seals. The projecting scraper bars 118 on the ends of the blade 18 and the projecting rear edge of the blade scrape solid objects from the container surfaces in advance of the blade seals to further protect the seals.

The packing blade 18 is normally retained in its upper retracted position by latch means 124 to be described presently. Suffice it to say at this point that the latch means embodies a stiff spring for normally retaining the latch means in blade latching position and a safety interlock for preventing release of the latch means to release the blade. When the interlock is disengaged, a sufficient downward force applied to the packing blade will effect retraction of the latch means against spring action and thereby release the blade for downward extension.

Packing blade operating means 20 creates air pressure forces on the blade 18 for driving the latter through its refuse packing cycle. Gravity aids downward extension of the blade through its refuse compression stroke.

The particular packing blade operating means 20 shown (FIGS. 11–14) comprises a combined pump and valve unit. This pump/valve unit comprises an air pump 126, such as a centrifugal blower, having air intake and exhaust ports and valve means 128 for selectively communicating either port to the compactor refuse space 15 and the other port to atmosphere. The packing blade 18 is extended downwardly through its packing stroke under the force of atmospheric pressure by operating the pump 126 with the valve means 128 set to evacuate the refuse space to atmosphere. The blade is retracted upwardly by air pressure by operating the pump 126 with the valve means 128 set to pressurize the refuse space 15 from atmosphere.

Figure 11:
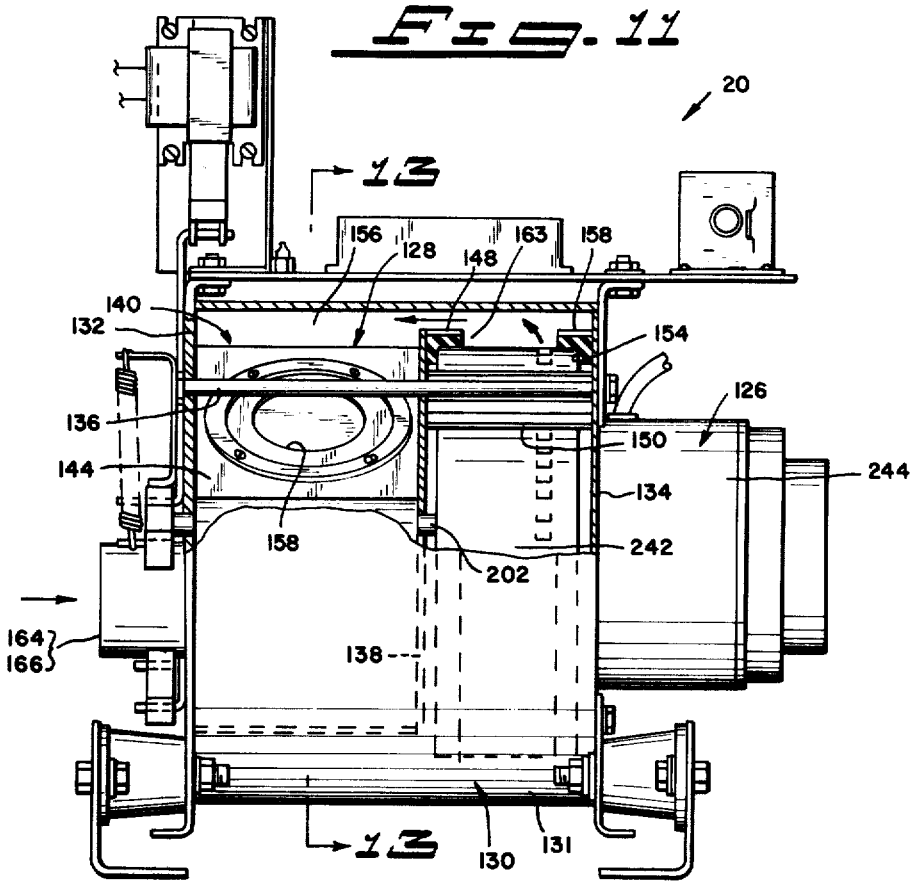
FIG. 11 is an enlarged side elevation, partly in section, of a combination pump and valve unit which constitutes the packing blade operating means for extending and retracting the compactor packing blade through its refuse packing cycle.
Figure 13:
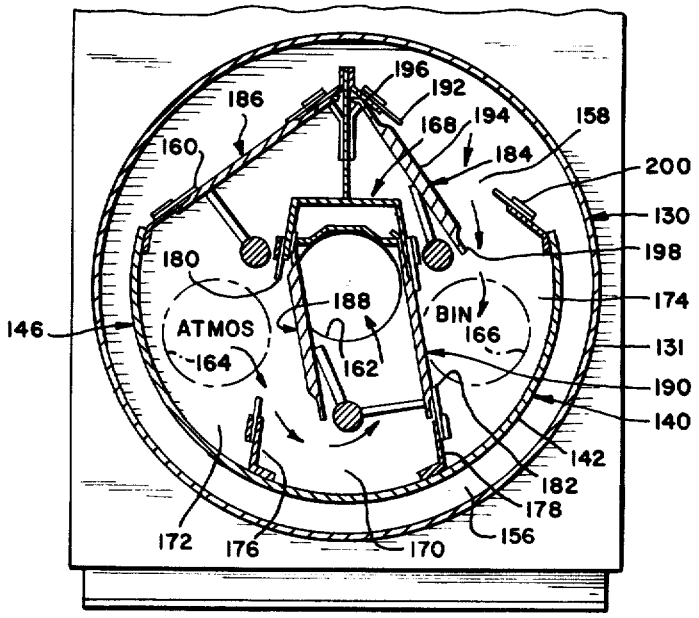
FIG. 13 is a section taken on line 13—13 in FIG. 11 showing the valve in the condition it occupies during upward return of the packing blade to its retracted position.

Referring to FIGS. 11 and 13, the combined pump-/valve unit 20 has a generally cylindrical housing 130 with a cylindrical side wall 131 closed at its ends by end walls 132, 134. These walls are held in assembled relation by long bolts or tie rods 136 extending through the housing.

Within and concentric to the housing 130 is a circular partition 138 between and parallel to the housing end walls 132, 134. Between the housing end wall and partition 138 is an annular wall 140 concentric with and spaced radially inward from the cylindrical housing side wall 313. This annular wall has a normally lower cylindrical portion 142 and two normally upper flat portions 144. The main housing end wall 132, partition 138, and annular wall 140 together form a housing 146 for the valve 128.

Joined to the partition 138 about its perimeter and extending toward the right hand housing end wall 134 in FIG. 11 is a cylindrical flange 148 and struts 150. The outer or right hand ends of the struts 150 in FIG. 11 seat against the wall 134 in surrounding relation to a cylindrical flange 152 on the inner side of the wall to locate the main housing 130 and valve housing 146 in concentric relation. Housing wall 134, partition 138, and struts 150 together form a rotor housing 154 for the air pump or blower 126.

The valve housing 146 and pump rotor housing 154 are radially spaced from the cylindrical wall 131 of the main housing 130 and define therebetween an annular airflow space 156. Entering the flat portions 144 of the valve housing 146 are ports 158, 160 communicating the interior of the valve housing to the annular flow space 156. The circumferential opening about the rotor housing 154 between its air sealed cylindrical flanges 148, 152 communicates outlet ports 163 of the rotor housing to the annular flow space 156.

Referring to FIGS. 11 and 13, the partition 138 has a port 162 on the housing axis communicating the interiors of the valve housing 146 and the rotor housing 154. This port forms the air intake port of the air pump 126. The left hand housing wall 132 has two ports 164, 166 opening to the interior of the valve housing. As will be explained presently, port 164 communicates to atmosphere. Port 166 communicates to the compactor refuse space 15.

Within the valve housing 146 is an interior wall or partition structure 168. This partition structure divides the interior of the housing 146 into three separate chambers 170, 172, 174 communicating with the ports 162, 164, 166 respectively. The partition structure includes walls 176, 178 containing ports 180, 182 communicating chambers 170, 172 and chambers 170, 174, respectively. The walls 176, 178 are upwardly convergent, like the walls 144.

Associated with the inclined valve ports 158, 160, 180, 182 are top hinged flapper valves 184, 186, 188, 190, respectively, for selectively closing the ports by seating engagement with flexible lip valve seats 192 about the ports. A significant feature of the valve 128 resides in the fact that air pressure, rather than mechanical means, is utilized to open the flapper valves. This eliminates the need for relatively large and powerful valve actuating means in order to prevent malfunctioning, e.g., by freezing of the valves closed in cold weather. The flapper valves 184, 186, 188, 190 are essentially identical as are their valve seats 192. Accordingly, a description of one flapper valve and its valve seat (valve 184 and its seat 192) will suffice for all.

With this in mind, flapper valve 184 comprises a rigid plate like valve flapper 194 having an upper end hingedly captivated at 196 by means on the partition structure 168. The valve flapper is thus hinged for swinging movement between its biased open position of FIG. 13 and its closed position of FIG. 14. The normally outer side of the flapper is edge relieved, as shown at 198 to provide a flat crown that is movable into the port for peripherally seating the lip of the corresponding valve 192.

Valve seat 192 is a relatively soft resiliently compliant seal ring of suitable rubber or plastic composition surrounding the corresponding valve port 158. Seating against the outer side of this seal ring is a clamp ring 200 which is secured to the valve housing 146 to hold the seal ring in position and leaving exposed a radial lip area that is substantially less the area of flapper 194 surrounded thereby.

Associated with the flapper valves 184, 186 are valve actuators 202, 204, respectively. Associated with the flapper valves 188, 190 is a single common actuator 206. Each valve actuator 202, 204 comprises a pivot shaft 208. This pivot shaft is located adjacent the inner side of the corresponding valve flapper 194 and parallel to the valve housing axis. Each shaft 208 is rotatably supported at its ends in the valve housing end walls 132, 138 and has an outer end exposed beyond the outer end wall 132. Radial arms 210, 212 are secured to the outer ends of the shafts 208 for the valves 184, 186, respectively.

Figure 14:
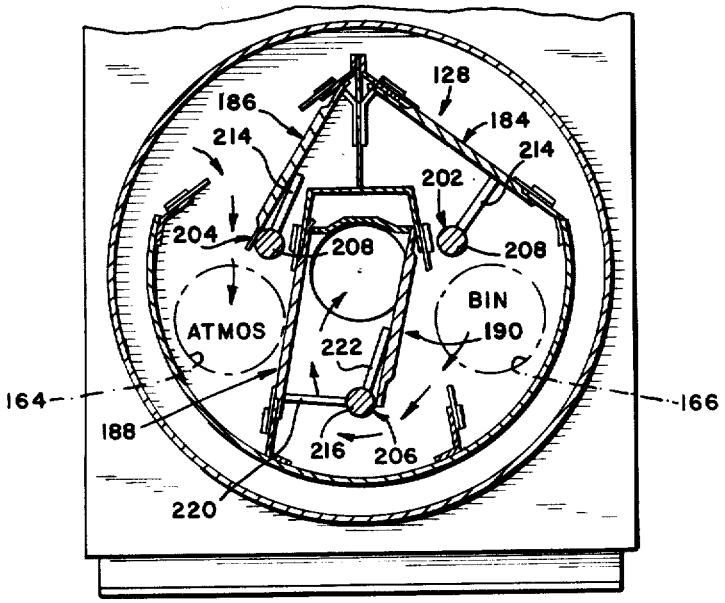
FIG. 14 is a section similar to FIG. 13 illustrating the valve in the condition it occupies during downward extension of the packing blade through its refuse packing stroke.

Fixed to the actuator shafts 208 are radial arm-like cams 214 for closing of the corresponding flapper valves 184, 186 in response to rotation of the shafts between their valve open and valve closed positions of FIGS. 13, 14. Thus, rotation of the actuator shaft 208 for flapper valve 184 to its valve closed position of FIG. 14, rotates the cam 214 against the valve to swing the latter outwardly to its closed position of seating engagement with its valve seat 192, wherein an air pressure differential across the flexible lip of ring 192 seals it against the periphery of flapper 194. Rotation of the shaft to its valve open position of FIG. 13 rotates its cam 214 inwardly away from the flapper valve 184 to release the latter for opening movement by differential air pressure as explained in more detail presently. Rotation of the actuator shaft 208 for valve 186 effects opening and closing movement of this valve in the same way.

Common valve actuator 206 for the flapper valves 188, 190 comprises a shaft 216 between the valves and parallel to the valve housing axis. Shaft 216 is rotatably supported at its ends in the valve housing end walls 132, 138 and has an outer end extending beyond the end wall 132. A radial cross-arm 218 is secured at its center to the outer end of this shaft.

Fixed to the actuator shaft 216 are a pair of radial arm-like cams 220, 222 for effecting closing movement of the flapper valves 188, 190 in response to rotation of the shaft. Thus, rotation of the actuator shaft 216 to its position of FIG. 13 rotates its cam 220 inwardly away from the flapper valve 188 to release the latter for opening movement by air pressure. Simultaneously, the shaft cam 222 rotates outwardly against the flapper valve 190 to close the latter. Rotation of the shaft 216 to its position of FIG. 14 rotates its cam 220 outwardly against flapper valve 188 to close the latter and rotates its cam 222 inwardly away from flapper valve 190 to release the latter for opening movement by air pressure.

Figure 12:
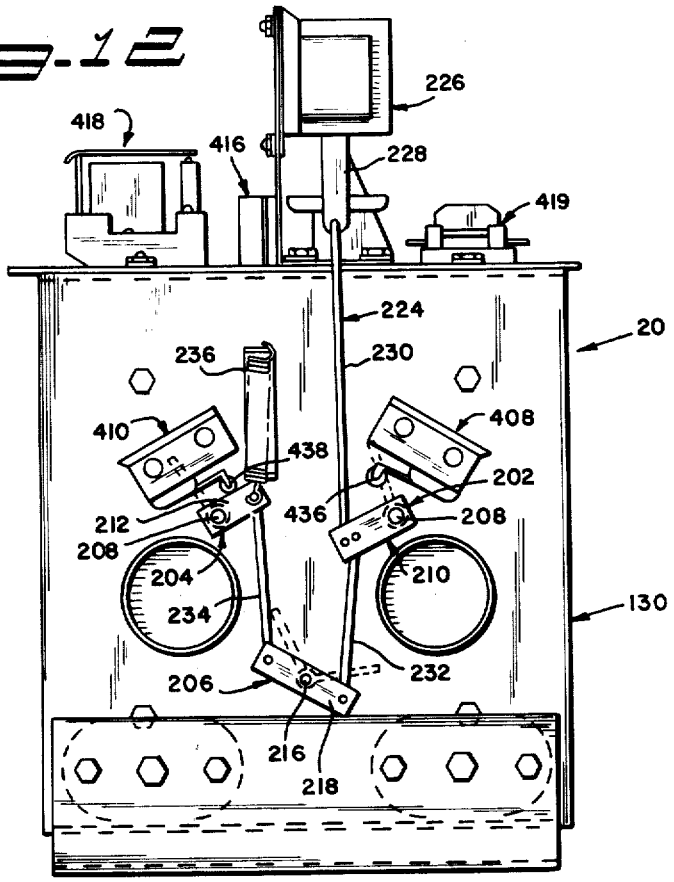
FIG. 12 is a view of the left hand end of the pump-/valve unit in FIG. 11.

Turning now to FIG. 12, the flapper valve actuators 202, 204, 206 are operatively connected to actuating means 224 for operating the flapper valves 184, 186, 188, 190 in unison between their open and closed positions of FIGS. 13 and 14. Actuating means 224 comprises a solenoid 226 mounted on top of the combined valve/pump unit 20. The plunger 228 of this solenoid is pivotally connected by a link 230 to the outer end of the arm 210 of the valve actuator 202. A second link 232 pivotally connects the outer end of the latter arm to one end of the cross arm 218 of the valve actuator 206. The opposite end of this cross arm is pivotally connected by a link 234 to the outer end of the arm 212 of the valve actuator 204.

The valve solenoid plunger 228 is normally extended, as shown in FIG. 12, and retracts upwardly when the solenoid is energized. This plunger retraction drives the flapper valve actuators 202, 204, 206 in unison, each in one direction. Connected between the outer end of the arm 212 of actuator 204 and the housing end wall 132 is a tension spring 236 for urging the actuators in the opposite direction and, thereby, the solenoid plunger 228 to its extended position of FIG. 12.

As shown in FIG. 12, the valve actuating means 224 is so arranged that when the solenoid plunger 228 occupies its extended position under the force of the spring 236 (solenoid 226 de-energized), the flapper valves 184, 186, 188, 190 occupy their positions of FIG. 13. Valves 184 and 188 are then open and valves 186, 190 are closed. Upward retraction of the solenoid plunger 228 in response to energizing of the solenoid 226 drives the actuators 202, 204, 206 in directions to close the flapper valve 184, open flapper valve 186, close flapper valve 188, and open flapper valve 190, as shown in FIG. 14.

Turning now to FIG. 2, it will be seen that the valve/pump unit 20 is mounted within a lower space at the rear of the rear refuse container wall 28. The valve port 164 communicates to atmosphere through a duct 238 which opens to an inlet air space, containing a filter if desired, below the unit. Valve port 166 communicates through a duct 240 to the earlier mentioned rear wall air passage 94 which opens to the bottom of the container refuse space 15.

Rotatable within the rotor housing 154 about the housing axis is an air pump rotor or impeller 242. This rotor is driven by a motor 244 mounted externally of the main valve/pump unit housing 130. Sealing means are provided between the motor and housing interior to isolate the motor from the air flow path through the valve and rotor housing. This is done in order to prevent ignition, by a spark in the motor, of any volatile material which may be contained in the air stream going through the pump and rotor housing as a result of the placement of a volatile substance within the refuse compactor.

Rotor 242, when driven in rotation, draws air into the rotor housing 154 from the valve housing 146 through the port 162. The rotor discharges this air through the rotor housing discharge ports 163 into the annular flow space 156 about the valve and rotor housings.

Consider now the operation of the refuse compactor 10 as described to this point. Assume that the compactor cover 16 is initially open, as in FIG. 1, to permit placement of refuse in the compactor. Assume also that the packing blade 18 is latched in its upper retracted position of FIG. 2 relative to the cover by the blade latch means 124.

When operating the compactor to compress refuse in the compactor container, the cover 16 is first closed and locked in position by cover latch means 246 to be described. This seals the cover to the lower compactor container body 14. As will be explained later, locking of the cover in its closed position effects actuation of the compactor valve 128 to its position of FIG. 14 by energizing of valve solenoid 226 and energizing the air pump motor 244 to drive its rotor 242.

The air pump rotor 242 is then operative to evacuate air from the compactor refuse space 15 through the air passage 94 and duct 240 (FIG. 2), valve port 166, valve chamber 174, valve port 182, valve chamber 170, and pump intake port 162 (FIG. 13) into the rotor housing 154. The rotor 242 expels the air from the rotor housing, through its exhaust port 162, into the annular air flow space 156. Air flow occurs from this space, through the valve port 160, valve chamber 172, valve port 164, and duct 238 to atmosphere.

In this operating mode of the refuse compactor, therefore, the compactor refuse space 15 is evacuated to atmosphere, and atmospheric pressure produces a downward force on the upper side of the packing blade 18. As explained presently, this atmospheric pressure force releases the blade from its latch means 124 and drives the blade downwardly through its refuse compression stroke. This operating mode of the compactor is referred to as its pack mode and the corresponding position of compactor valve 128 as its pack position.

Normally, the compactor valve 128 is shifted, in the manner explained later, to its position of FIG. 13 in response to either swinging of the packing blade 18 through its full packing stroke or expiration of a preset time interval. Operation of the air pump 126 in this condition of the valve 128 draws in air from atmosphere through duct 238 and valve port 164. Air flow occurs from the port 164, through the valve chamber 172, port 180, chamber 170, and pump intake port 162 into the pump rotor housing 154. Air exhausts from the rotor housing into the annular valve flow space 156 and then flows from this space through the valve port 158, chamber 174, port 166, and duct 240 into the compactor refuse space 15.

In this operating mode of the refuse compactor, therefore, the refuse space 15 is pressurized from atmosphere. The resulting upward pressure force on the packing blade 18 drives the blade upwardly to its retracted position. The blade latch means 124 re-engages to latch the plate in this retracted position. This completes one refuse packing cycle of the packing blade. This operating mode of the compactor is referred to as its packing blade return mode and the corresponding position of compactor valve 128 as its packing blade return position.

At this point, it is worth mentioning that the valve 128 is shifted between its positions of FIGS. 13 and 14 when the air pump 126 is stopped. The only forces, if any, then acting on the valve flappers 184, 186, 188, 190 is gravity. The valve actuators 202, 204, 206 and actuating means 224 are thus capable of closing the flappers with ease. The flappers are opened by gravity and/or the air pressure differential created across the flappers by operation of the air pump 126.

Opening of the valve flappers 184, 186, 188, 190 by this air pressure differential rather than by electromechanical means constitutes an important feature of the invention. Thus, when the valve flappers are closed, the air pressure forces produced on the flappers by the air pump 126 tending to open the flappers are relatively large because of the relatively large effective area of the flappers. These large pressure forces are effective to open the flapper valves even though the latter freeze closed in cold weather.

In addition to the structure described thus far, the refuse compactor 10 includes a control circuit 248 (FIG. 10) for initiating and controlling its operation. This circuit has two primary features. As one, the control circuit embodies a key lock for the cover 16, and the packing blade 18 is automatically driven through a refuse packing cycle each time the cover is closed and locked in position by the key lock. The second feature of the control circuit is a safety feature, whereby the packing blade cannot be cycled, and in fact is positively locked in retracted position, until the cover 16 is locked closed with the key lock.

Referring to FIGS. 4 through 7, the packing blade latch means 124 has a latch mechanism 249 including a mounting bracket 250. This bracket has a flat base plate 252 and a generally yoke shaped plate 254. Plate 254 is welded at its ends to the base plate to form with the latter plate end mounting tabs 256. The central portion of the plate 254 is spaced from the base plate 252 to form an opening 258 through the bracket. Bracket 250 is located on a transverse frame member of the compactor cover 16, adjacent the rear edge of the cover, by bolts 260 extending through the bracket tabs 256 and the frame member.

Positioned side by side within and parallel to the plane of the bracket opening 258 are a latch plate 262 and a cam plate 264. These plates are pivotally mounted on a common pivot shaft or journal 266. Pivot shaft 266 is nonrotatively fixed to and extends through the bracket plates 252, 254, normal to the plane of the bracket opening 258. The outer end of the pivot shaft extends a distance beyond the outer bracket plate 254. A strong torsion spring 268 surrounds the outer shaft end and has a hook at its outer end engaging about a cross-pin 270 in the shaft. The inner spring end 272 bears against the normally co-planar edges 274 of the latch and cam plates 262, 264 to bias the plates clockwise in FIG. 6, 6a.

Clockwise pivoting of the latch plate 262 by the spring 268 is limited by a stop 276 on the bracket 250 engagable by the plate edge 274. This limiting position of the latch plate is its extended packing blade latching position. A stop pin 278 on the latch plate extends through a slot 280 in the cam plate 264 to form a lost motion connection which limits pivotal movement of the cam plate relative to the latch plate. Spring 268 urges the cam plate clockwise to its extended position of FIG. 6 relative to the latch plate.

Entering the leading edges of the latch and cam plates 262, 264, relative to the direction in which the plates are urged by the spring 268, are notches 282. As viewed in FIG. 6, the lower shoulder edge 284 of the latch plate notch 282 is slightly higher than the lower shoulder edge 286 of the cam plate notch. Below these notches, the plates have bevelled cam edges 288, 290 respectively. In addition to the latch mechanism 249, the pressure plate latch means 124 comprises a latch member or roller 292 mounted on an upstanding post 294 welded to the packing blade 18. Latch roller 292 is located at the upper side of the blade in a position to rest on the lower latch plate shoulder 284 when the latch plate occupies its latching position of FIG. 6.

Figure 6:
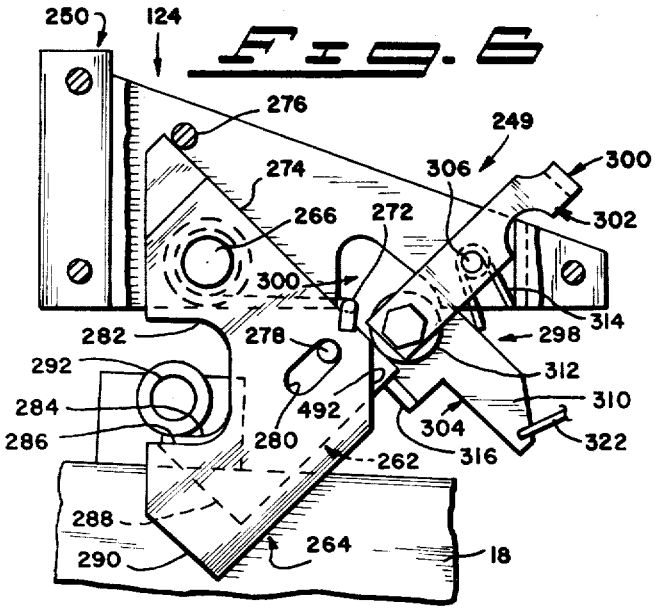
FIG. 6 is an enlarged fragmentary detail of the packing blade latch means in its blade latching position.
Figure 7:
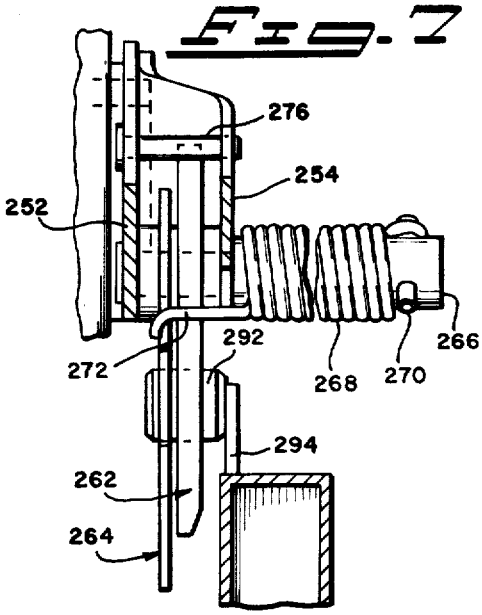
FIG. 7 is an end view of the packing blade latch means in FIG. 6.

It will be observed in FIG. 6, that in this packing blade latching position, a downward force on the blade 18 due to gravity and atmospheric pressure when the refuse space 15 is evacuated is transmitted from the latch roller 292 to the latch plate 262 along a line of action laterally spaced from the latch plate journal 266. This force thus tends to cam first the latch plate 262 and then the cam plate 264 counterclockwise from their extended positions of FIG. 6 to their retracted positions of FIG. 6a. In these retracted plate positions, the latch mechanism 249 releases the packing blade 18 to swing through its downward refuse packing stroke.

The spring force holding the latch and cam plates 262, 264 in their extended latching positions of FIG. 6 is made sufficiently large to require both gravity and atmospheric pressure on the packing blade 18 to release the latch mechanism 249. Following disengagement of the blade 18 from the latch mechanism 249, the latch and cam plates 262, 264 return by spring action to their extended latching positions of FIG. 6. Engagement of the packing blade latch roller 292 with the bevelled camming edges 288, 290 of the latch and cam plates during upward return of the blade to its retracted position retracts the plates against spring action to permit full retraction of the blade, as explained in more detail later. The latch and cam plates then return by spring action to again latch the packing blade in its retracted position.

Figure 4:
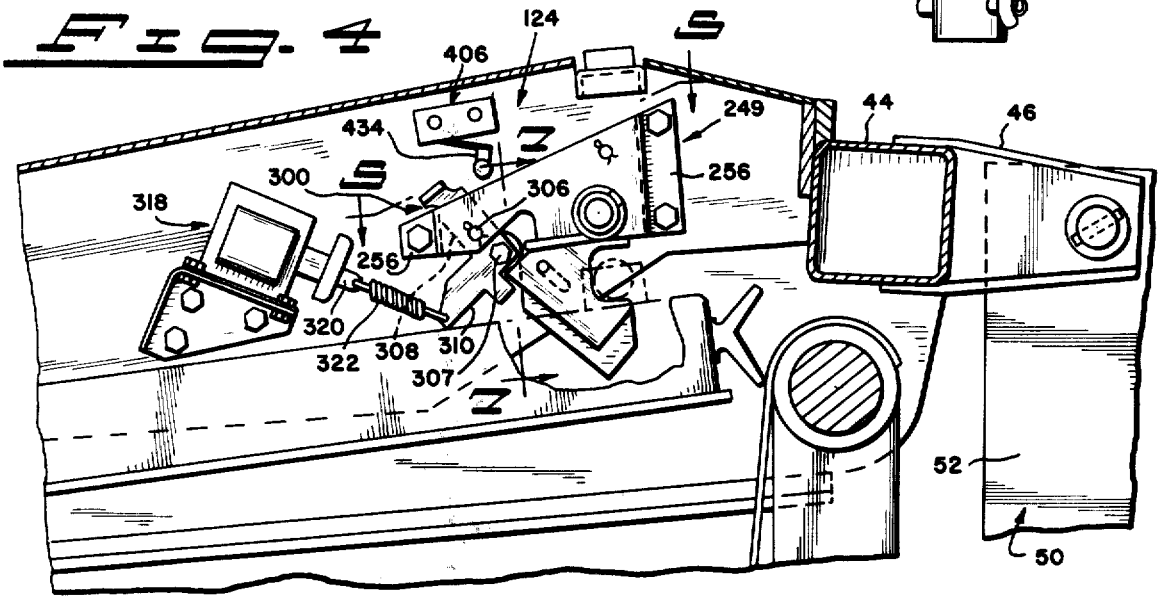
FIG. 4 is an enlarged fragmentary section illustrating the packing blade latch means for retaining the blade in its retracted position relative to the compactor cover.

As noted earlier, and will be explained in more detail presently, the packing blade latch means 124 is interlocked against releasing the blade 18 except when the compactor cover 16 is locked in closed position. This interlocking function is performed, in part, by an interlock device 298 embodied in the packing blade latch mechanism 249 (FIGS. 4, 6).

Interlock device 298 comprises a pivotal interlock member 300 located in latch bracket opening 258, at the trailing sides of the latch and cam plates 262, 264 relative to the direction in which these plates are urged by the spring 268. The interlock member comprises a pair of arms 302, 304 disposed side by side on a common pivot shaft 306 parallel to the latch pivot shaft 266. Arm 302 is essentially straight and pivotally mounted between its ends on the pivot shaft 306. Arm 304 is a generally L-shaped arm pivotally mounted at one end on the pivot shaft 306.

Arm 304 has two mutually perpendicular ends 308, 310. Arm end 308 is disposed in parallel side by side relation with the arm 302. Arm end 310 extends normal to the arm 302 and arm 308 and below the lower side of the latch bracket 250. Rotatably mounted between the arms 302, 304 on a shaft 307 is a roller 312, at the elbow of arm 304.

A torsion spring 314 acts between the latch bracket 250 and the interlock arm 304 to urge the interlock member 300 clockwise in FIG. 6 about its pivot shaft 306 to the position shown in the drawing. This position is hereafter referred to as the engaged position of the interlock member. Clockwise rotation of the interlock member in FIG. 6 is limited to this engaged position by contact of a stop 316 on the lower interlock arm end 310 with the lower edge of the latch plate 262.

In the engaged position of the interlock member 300, its roller 312 engages the upper trailing edge of the latch plate 262 to prevent counterclockwise rotation or retraction of the plate from engagement with the pressure plate latch roller 292. Thus, the interlock member 300, when in its engaged position, interlocks the pressure plate latch means 124 against releasing the packing blade 18 for swinging movement through its refuse packing cycle.

The interlock member 300 is rotatable counterclockwise from its engaged position of FIG. 6 to a retracted or disengaged position shown in FIG. 6*a*. In its disengaged position, the interlock roller 312 clears the latch plate 262, thereby releasing or conditioning the latch means 124 to release the packing blade 18 for swinging movement through its refuse packing cycle.

Latch means 124 also comprises an interlock actuator 318 (FIG. 4). This actuator is operable to retract the interlock member 300 (clockwise in FIG. 4, counterclockwise in FIG. 6) against the action of its spring 314 to it disengaged position. The illustrated interlock actuator is a solenoid whose plunger 320 is connected by a spring 322 to the lower end 310 of the interlock member. Energizing of the solenoid retracts its plunger to retract the interlock member 300 counterclockwise in FIG. 6 to its disengaged position of FIG. 6*a*.

The compactor cover latch means 246 will now be described by reference to FIGS. 1, 2, 8, 9, 15, and 16. This cover latch means is located at the front side of the compactor container 12. The latch means comprises a pair of essentially identical latch mechanisms 322 mounted on the front container wall 26. A handle bar 324 connects the latch mechanisms for operation in unison to lock and release the cover 16.

Each cover latch mechanism 322 has a mounting bracket 326 welded or otherwise rigidly joined to the front container wall 26, just below its upper edge channel 66. Bracket 326 has spaced parallel side plates 327. A pair of latch operating arms or levers 328 have inner ends straddling the lower end of the bracket 326 and pivotally attached to the bracket by a pivot shaft 330 extending through the levers and bracket plates 327. The pivot shafts of the two cover latch mechanisms 322 are coaxial. The opposite or outer ends of the levers 328 are rigidly joined to a handle bar 324. Thus, the latch operating levers 328 of both cover latch mechanisms 322 are rotatable in unison about their coaxial pivot shafts 330 by the handle bar 324.

Each cover latch mechanism 322 includes a pair of generally L-shaped latch arms 332. Each latch arm has mutually transverse lower and upper ends 334, 336. Latch arms 332 are rigidly joined adjacent their elbows by a cross-member 338 and at their upper extremeties by a latch pin 340. The lower ends 334 of the latch arms 332 are located between the latch operating levers 328 and are pivotally joined to the levers by a pivot shaft 342.

Surrounding the pivot shaft 342 is a torsion spring 346. The ends of this spring engage a cross-pin 348 welded to and extending between the latch levers 328 and a cross-pin 350 extending between and rigidly joined to the latch arms 332. This spring urges the latch arms 332 counterclockwise in FIG. 8 about their pivot shaft 342 to the position of FIG. 8. In this position, the latch arms extend upwardly from the levers 328 and the upper ends of the arms bear rearwardly against the compactor container.

Figure 8:
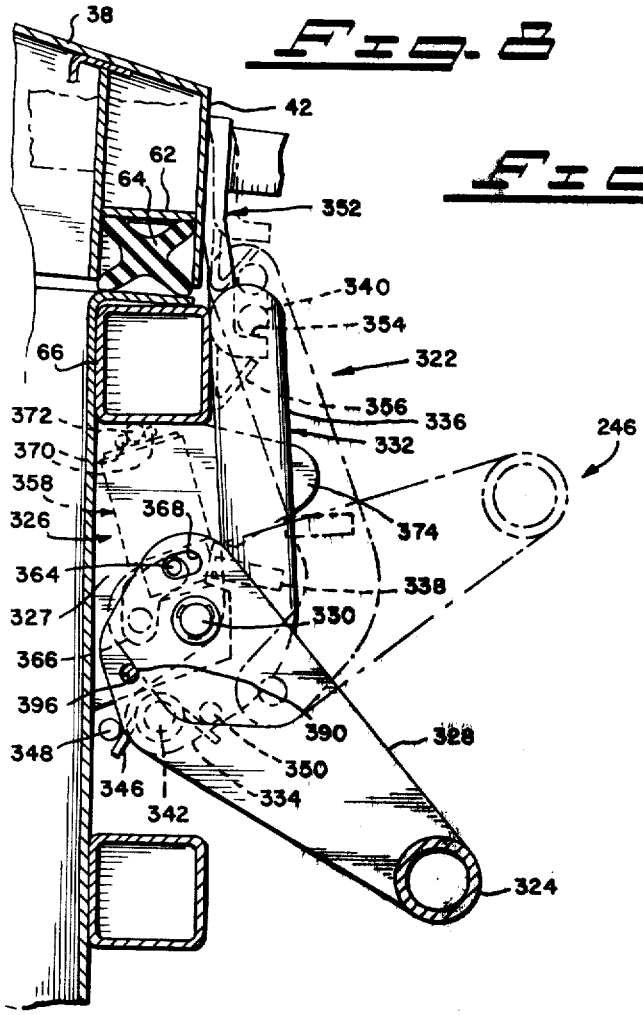
FIG. 8 is an enlarged fragmentary section taken on line 8—8 in FIG. 9 illustrating the compactor cover latch means.
Figure 9:
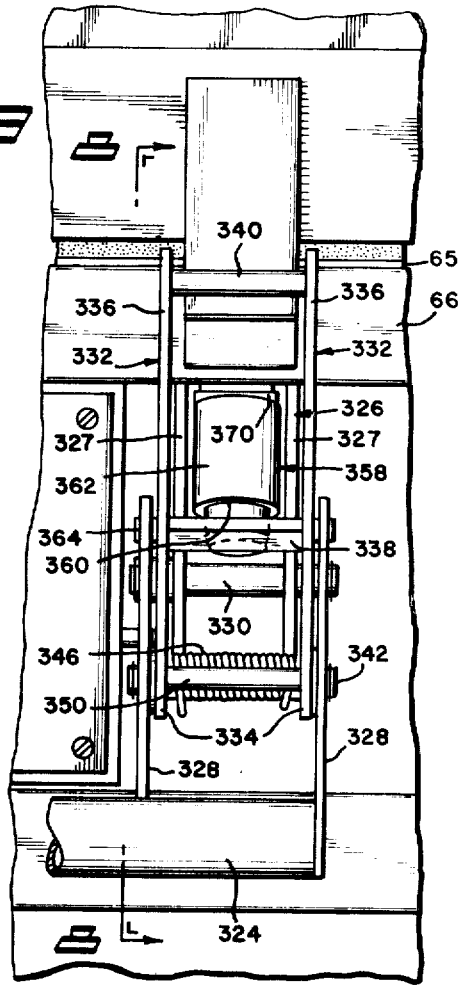
FIG. 9 is a front view of the latch means of FIG. 8.

The latch operating levers 328 and the latch arm 332 are movable by the handle bar 324 between their lower solid line positions and upper broken line positions of FIG. 8. The lower solid line positions of the levers and arms are their cover locking positions. The upper broken line positions of the levers and arms are hereafter referred to as their primary catch positions.

Associated with each cover latch mechanism 322 is a catch 352 welded or otherwise rigidly joined to the front edge flange 42 of the compactor cover 16 directly over the latch mechanism. This catch has an upwardly facing latch shoulder 354 for engagement by the latch pin 340 of the corresponding cover latch mechanism 322, in the manner shown in FIG. 8 and described below. Below this latch shoulder is fixed a V-shaped part forming a bevelled cam surface 356.

Captivated between the side plates 327 of each cover latch bracket 326 is a spring cartridge 358. This spring cartridge includes a lower plunger 360 movable endwise in an upper barrel or cylinder 362. Cylinder 362 contains a spring (not shown) for urging the plunger 360 downwardly from the lower end of the cylinder.

Fixed to the lower end of the spring cartridge plunger 360 is a cross-pin 364 parallel to the latch pivot shafts 330, 342. Cross-pin 364 extends through L-shaped clearance slots 366 in the latch bracket side plates 327 and into slots 368 in the inner pivoted ends of the latch operating levers 328. The upper end of the spring cartridge barrel 362 has welded thereto a pair of cross-pins 370. These cross-pins straddle a pin 372 welded to the underside of the upper container front wall edge channel 66. Pins 370, 372 form a pivot for the spring cartridge 358 having the pins 372 as a pivot shaft. This pivot shaft parallels the latch pivot shafts 330, 342.

Each cover latch mechanism 322 is so constructed and arranged that when the latch levers 328 occupy their lower solid line cover locking positions of FIG. 8, the spring cartridge plunger 360 is retracted into the cartridge cylinder 362 against the force of the cartridge spring. The cartridge thus exerts a spring force on the latch levers 328 through the plunger cross-pin 364. In this position of the latch levers 328, however, the lever pivot shaft 330, spring cartridge plunger 364, and spring cartridge pivot shaft 372 are aligned in a common plane. Accordingly, the spring cartridge then produces no moment on the latch levers 328 in either direction of their rotation.

When the latch levers 328 are rotated in a counterclockwise direction in FIG. 8 toward their upper broken line primary catch positions, the spring cartridge plunger shaft 364 moves counterclockwise about the lever pivot shaft 330. During this movement the spring cartridge 358 pivots about its upper pivot shaft 372. The line of action of the cartridge spring force on the levers 328 then passes to the left of the lever pivot shaft 330 in FIG. 8. Accordingly, the spring force exerts a counterclockwise moment on the levers 328 urging the latter and the latch arms 332 to their upper broken line primary catch positions of FIG. 8.

During upward movement of the latch arms 332 with the latch levers 328 by the spring bias of the spring cartridge 358, the latch arm cross-member 338 rides upwardly along the front edge of the latch bracket side plates 327. These front plate edges have portions which project forwardly to provide cam formations 374. The cross-member 338 rides along these cam formations to effect release of the cover 16 for opening under the spring force of the counterbalance units 50 when the latch levers 328 are raised above their primary catch positions, as explained later.

Assume now that the compactor cover 16 occupies its open position of FIG. 1. Assume further that the cover latch levers 328 and latch arms 332 are biased by their spring cartridges 358 to their upper broken line primary catch positions of FIG. 8. The cover 16 is closed by pulling down on the cover handle bar 56. As the cover 16 approaches its closed position, the cam surfaces 356 below the front cover latch shoulders 354 engage the upper latch pins 340 on the cover latch arms 332. Continued closing of the cover then cams the upper ends of these latch arms forwardly or outwardly away from the compactor against the action of the latch arm springs 346. As soon as the latch pins 340 clear the latch shoulders 354, the springs 346 return the upper ends of the latch arms inwardly or rearwardly to positions wherein their latch pins 340 engage over the latch shoulders 354. The cover 16 is then latched in its primary catch position. In this primary catch position, the cover 16 is not completely closed. A sufficient gap exists between the cover and the upper wall edges of the lower container body 14 to avoid the possibility of a person's fingers being pinched between the cover and container body.

The compactor cover 16 is fully closed and latched in closed position by pulling down on the cover latch handle 324 after the cover has been latched in its primary catch position. This action rotates the cover latch levers 328 clockwise and downwardly in FIG. 8 about their pivot shafts 330 and thereby pulls downwardly the cover latch arms 332 from their upper primary catch positions to their lower cover locking positions of FIG. 8. The latch arms 332 thus exert on the cover 16, through engagement of the latch pins 340 with the cover latch shoulders 354, a downward closing force on the cover. This closing force fully closes the cover against the upward bias of the cover counterbalance units 50. During this final closing of the cover, its resilient seals 64, 72 are compressed between the cover and the upper edges of the container body walls to seal the cover to the container body 14, as described earlier.

It will be observed in FIG. 8 that during this final closure of the compactor cover 16 by the cover latch means 246, the pivot shaft 342 of each cover latch mechanism 322 connecting the latch arms 332 to their lever arms 328 rotates past the line of centers between the lever pivot shafts 330 and their latch pins 340. In other words, the cover latch mechanisms 322 embody a toggle locking action which releasably locks these mechanisms in their cover locking positions. Compression of the cover seals 64, 72 provides the required resiliency for this toggle locking action.

The compactor cover 16 is released to swing to its open position of FIG. 1 by rotating the cover latch levers 328 upwardly beyond their broken line primary catch positions of FIG. 8. This action causes the latch arm cross-members 338 to ride upwardly along the cam formations 374 on the latch bracket side plates 327. These cam formations cam the upper ends of the cover latch arms 332 outwardly to disengage their latch 340 from the cover latch shoulders 354. The cover is thus released to swing open under the upward spring force of the cover counterbalance units 50.

In addition to the latch mechanism 322, the cover latch means 246 includes a key lock unit 380 (FIGS. 1, 15, 16). This key lock unit has a rectangular housing 283 bolted or otherwise firmly attached to the front wall 26 of the compactor container 12 directly adjacent one side of one of the cover latch mechanisms 322, in this instance the right hand latch mechanism in FIG. 1.

Mounted on the front wall 384 of the key lock housing 382 is a rotatable key lock 386 proper. This key lock is accessible at the front side of the housing to receive a key for rotating the lock. The lock is rotatable between its solid line unlocked or cover releasing position and its broken line locked or cover locking position of FIG. 16.

Slidable in a bearing 388 at the side of the key lock housing 384 adjacent cover hatch mechanism 322 (i.e., the right hand side in FIGS. 15 and 16) is allock bolt or pin 390. The inner end of this lock pin is pivotally connected by a link 392 to a radial arm 394 rigid on the rotatable element of the key lock 386. Counterclockwise rotation of the key lock to its solid line unlocked position retracts the lock pin 390 inwardly to its solid line retracted position of FIG. 16. In this position, the outer end of the lock pin is flush with the lock housing 384. Clockwise rotation of the key lock 386 to its broken line locking position extends the lock pin outwardly to its broken line locking position of FIG. 16. In this position, the lock pin projects a distance beyond the right hand side of the key lock housing 384.

The cover latch mechanism 322 adjacent the key lock unit 380 has a hole 396 extending through that one of its latch levers 328 adjacent the lock unit. The latch mechanism and key lock unit are relatively located in such a way that the lock pin 390 and latch hole 396 are co-axially aligned when the latch levers 328 occupy their lower locking positions of FIG. 8. Under these conditions, rotation of the key lock 386 to its cover locking position extends its lock pin 390 into the aligned latch hole 396 to lock the cover latch means 246 in its cover locking position. Assuming the compactor cover 16 is closed, this rotation of the key lock to locking position locks the cover in closed position.

It will be seen that a key is required to open the container compactor in order to deposit refuse thereinto. Let it be assumed that while the cover 16 is open, the operator desires to leave the container compactor unattended for whatever reason. This can be safely accomplished in the following manner.

Assuming the cover 16 to be open, the operator moves the handle bar 324 downwardly thus moving the latch operating levers 328 and latch arms 332 downwardly to the lower solid line positions indicated in FIG. 8. This brings the lock bolt hole 396 of latch lever 328 into alignment with the lock bolt 390 permitting the operator, by use of the key, to turn the key lock 386 clockwise as viewed in FIG. 16 to move the lock bolt 390 into locking engagement with the adjacent latch mechanism 322. Thus, the only way the operator can retrieve the key, while the cover 16 is open, is by returning the latch mechanisms 322 to the lowermost positions of the solid line of FIG. 8.

In the just described condition of the compactor container, i.e., with the cover opened and the key removed, unauthorized persons not having a key cannot latch the cover 16 of the container in closed position. Since the latch levers 328 are locked in lowered position by the bolt 390, the latch arms 332 cannot be raised. Accordingly, the pivot axis 340 of the latch arms 332 is locked in lowered position such that the latch pin 340 cannot engage the top side of the projecting lip of the catch 352. Therefore, if the cover 16 is now fully lowered, the cam noses 356 of catches 352 will deflect the latch pins 340 outwardly about their pivot axes 342 but then the upper ends of the cam noses are so located as to prevent the latch pins entering on top of the projecting lip of the catches 352. Stated otherwise, the latch mechanisms 322 must be raised to the primary catch positions before the latch pins 340 can swing on their axes 342 onto the catches 352.

Figure 10:
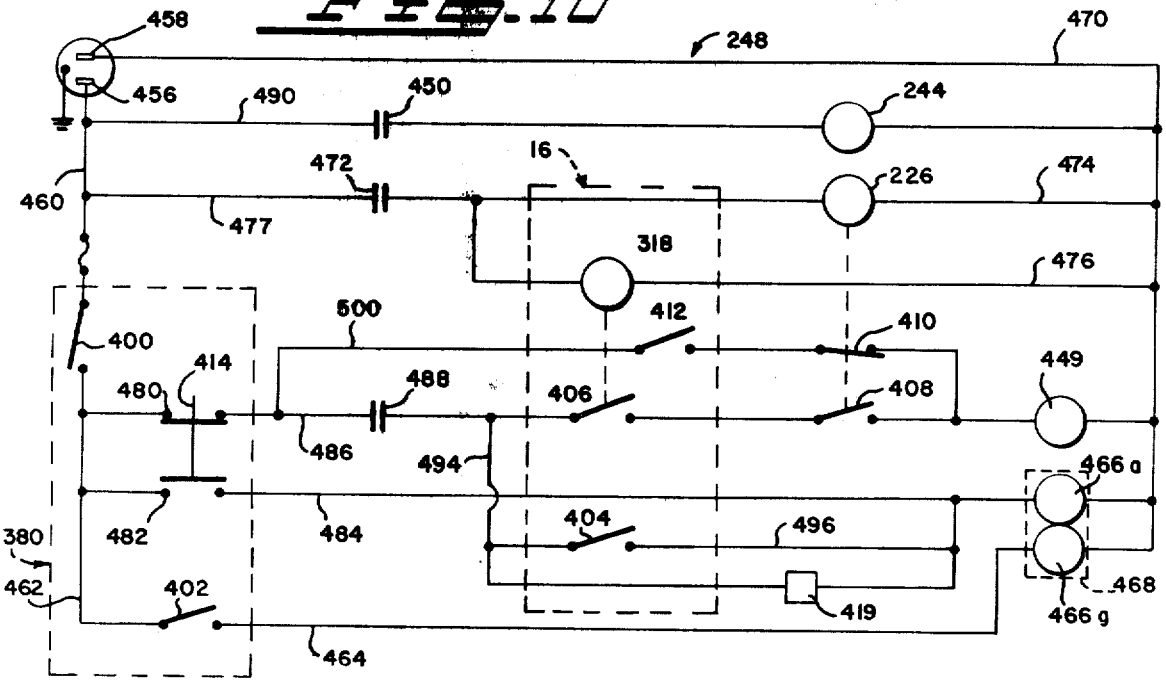
FIG. 10 is a control circuit embodied in the refuse compactor.

An noted earlier, the refuse compactor 10 embodies a control circuit 248 for controlling the operation of the compactor packing blade 18. This control circuit is schematically illustrated in FIG. 10 and will now be described. The control circuit embodies a number of components which appear on other Figures of the drawings. These components are listed below followed, in parentheses, by the numbers of the other drawing Figure or Figures in which the components appear and will be described first.

The components referred to above are switches 400 (FIG. 16), 402 (FIG. 16), 404 (FIG. 2*a*), 406 (FIG. 4), 408 (FIG. 12), 410 (FIG. 12), 412 (FIG. 2), 414 (FIG. 16), relays 416 (FIG. 12), 418 (FIG. 12), solenoids 226 (FIG. 12), 318 (FIG. 4), air pump motor 244 (FIG. 11), and a timer 419 (FIG. 12).

Switch 400 (FIG. 16) is a normally open compactor cover position sensing switch mounted in the cover key lock housing 382 below a vertically slidable plunger 420 in the housing. Plunger 420 is aligned with a shaft 421 thar is vertically slidable in a bracket 422 fixed to the left hand end wall of the housing in FIG. 16. A spring 424 biases the shaft 421 upwardly against the lower end of plunger 420. The upper end of the plunger 420 extends through the top of the key lock housing 382 and through the channel 66 along the upper edge of the compactor front wall 26. When the cover 16 is raised, the upper end of the plunger 420 projects above the channel 66, as shown in FIG. 1.

When the compactor cover 16 occupies its primary catch position, a stud 423 on the lower side of the front cover edge just engages or is located closely adjacent the upper extending end of the plunger 420. Upon closure of the cover 16 from its primary catch position to its fully closed position the stud 423 depresses the plunger 420 downwardly to move shaft 421 against a button 426 of the switch 400 to close the latter switch. This switch thus remains closed as long as the compactor cover 16 remains fully closed.

Switch 402 (FIG. 16) is a normally open key lock actuated switch also mounted in the key lock housing 382. This key lock actuated switch has a unidirectionally responsive knee action plunger 428 located in the path of rotation of the key lock arm 394 between its solid line unlocked position and its broken line locked position of FIG. 16. Rotation of the key lock 386 to locked position thus momentarily closes the switch 402 while rotation of the key in the opposite direction has no effect on the switch, due to the knee action of the switch arm.

Switch 404 (FIG. 2*a*) is a normally closed down-limit switch for the compactor packing blade 18. This switch is mounted on the underside of the cover 16 adjacent the front hinged edge of the blade. Mounted on the hinged front edge of the blade 18 is a radial arm 430. This blade arm engages the switch arm 432 to open the switch 404 when the blade 18 occupies its lower fully extended position shown in broken lines in FIG. 2.

Switch 406 (FIG. 4) is a normally open packing blade interlock switch mounted on the underside of the compactor cover 16 adjacent the blade latch mechanism 249. This switch has an actuating arm 434 located in the path of rotation of the upper end of the packing blade latch interlock member 300 about its pivot shaft 306. When the interlock member 300 occupies its normal engaged position of FIG. 6, the interlock switch 406 is released to occupy its normal open position. When retracted to its disengaged position of FIG. 6*a*, by its solenoid 318, the upper end 302 of the interlock member 300 engages and depresses the interlock switch arm 434 thereby closing the interlock switch 406.

Thus, switch 406 is open when the interlock device 298 is engaged to interlock the packing blade latch mechanism 249 against releasing the blade 18. The interlock switch is closed when the interlock solenoid 318 is energized to disengage the interlock device 298 and thereby release the latch mechanism 249 for releasing the packing blade 18.

Switches 408, 410 (FIG. 12) are normally open air valve mode switches mounted on the front end wall of the air valve/pump housing 130. Switch 408 has an actuating arm 436 located in the path of rotation of the valve arm 210. The switch 408 is closed by this valve arm upon actuation of the compactor air valve 128 to its pack position of FIG. 14. Switch 410 has an actuating arm 438 located in the path of rotation of the valve arm 212. Switch 410 is closed by the valve arm 212 upon actuation of the compactor air valve to its packing blade return position of FIGS. 12 and 13.

Switch 412 (FIG. 2) is a normally closed up-limit switch for the packing blade 18. This switch is mounted on the underside of the compactor cover 16 adjacent the rear edge of the blade. Fixed to and upstanding from the top side of the blade 18 is a projection 440 which engages the switch arm 442 to open the switch 412 upon arrival of the blade in its fully retracted position of FIG. 2.

Switch 414 (FIGS. 15, 16) is a normally closed push button switch mounted in the key lock housing 382. The push button 444 of this switch is accessible at the front side of the housing for manual depression to open the switch 414.

Relays 416, 418 (FIG. 12) are mounted on top of the compactor valve/pump housing 130. Relay 416 has a solenoid 445 and two sets 446, 448 of normally open contacts. Relay 418 has a solenoid 449 and a single set of normally open contacts 450.

Timer 419 (FIG. 12) is also mounted atop the valve/-pump housing 130. This timer has normally closed contacts 452 operable by a timing device 454 which momentarily opens the contacts after a preset interval, such as 60 seconds, following momentary energizing of the timer.

The compactor operation will now be described by reference to the compactor control circuit diagram of FIG. 10.

Electrical power is supplied to the compactor through terminals 456, 458. These terminals may be the prongs of an electrical plug for insertion into a 110 volt recepticle.

Assuming the compactor cover 16 is initially open, and the cover key lock 386 is in its unlocked position, the compactor control circuit 248 will assume its deenergized condition of FIG. 10.

The initial step in operating the compactor through a packing cycle is closing of the compactor cover 16 and locking it in closed position. This is accomplished by first pulling down on the cover handle bar 56 to lower the cover to its primary catch position shown in broken lines in FIG. 8. The cover is then fully closed and latched in closed position by pulling down on the cover latch handle bar 324 to operate the cver latch means 246 to its solid line fully latched or engaged position of FIG. 8.

This closure and latching of the cover 16 depresses the switch plunger 420 in the key lock housing 382 to close the switch 400. Operation of the cover latch means 246 to its cover locking position also aligns its lock pin hole 396 with the lock pin 390 of the key lock unit 380.

The next step in the compactor operation is rotation of the cover key lock 386 from its solid line unlocked position to its broken line locked position of FIG. 16 by a key inserted into the lock. This key lock rotation extends the lock pin 390 into the cover latch hole 396 to lock the cover latch means 246 in latched position and, thereby, the compactor 16 in its closed position. Rotation of the key lock 386 to its locked position also effects momentary closure of the key lock switch 402 by engagement of the key lock arm 394 with the unidirectionally effective switch arm 428.

As is shown in FIG. 10, this momentary closure of the key lock switch 402, with the compactor cover switch 400 closed, momentarily completes an electrical circuit from the power terminal 456 through lead 460, cover switch 400, lead 462, key lock switch 402, a lead 464 to one coil **466*b* of a relay 468, and a lead 470 to the other power terminal 458**.

The relay 468 has dual coils **466*a* and 466*b* and an armature which is mechanically latched in the last energized position. The coil 466*b* having been momentarily energized, the armature of the relay shifts to effect mechanical closing of normally open contacts 472 in a lead 477 from the power line 460. In series relation to the normally open relay contacts 472 are parallel leads 474, electrically connected to the air valve control solenoid 226, and a lead 476 that is electrically connected to the solenoid 318 of the pressure plate latch means 124**.

The manual override switch 414 is a double pole double throw type having normally closed contacts 480 and another pair of normally open contacts 482, the latter being contained in a lead 484 from the power lead 460 that also contains the coil **466*a* of the relay 468 in series with the normally open contacts 482. The normally closed contacts 480 of the push button switch 414 are mounted in another lead 486, in electrical parallel to the lead 484, and also including normally open relay contacts 488 that are also mechanically closed by the armature of the relay 468 when the coil 466*b* is energized. Mounted in the lead 486, in series relation to the normally open relay contacts 488, are the normally open switch 406 of the pressure plate latch means 124, the normally open switch 408 of the air valve control means, and a motor relay 449. The relay 449 has normally open contacts 450 in a lead 490 from the power lead 460, connected in series with the air pump motor 244**.

The momentarily closed key switch 402 having now been returned to open condition, the contacts 472, 488 of the relay 468 nevertheless remain closed by virtue of the mechanically latched then position of the relay armature. Accordingly, the air valve control solenoid 226 is energized to close the switch 408, accordingly setting the air valve 128 in the condition illustrated in FIG. 14 in readiness for evacuation of air from the loading bin of the compactor. As the solenoid 318 of the pressure plate latch means 124 is also energized, its switch 406 is also closed, as are the relay contacts 488, thus energizing the relay 449 to effect closing of the normally open contacts 450 to start the air pump motor 244. As a result, air is evacuated from the container to effect descent of the pressure plate 18 and compaction of the refuse within the container. As the pressure plate 18 departs from the cover 16, the up limit switch 412 moves to closed position.

As previously mentioned, retraction of the pressure plate occurs as a result of either closing of the pressure plate down limit switch 404, running out of the cycle of the timer 419, or by manual override depression of the push button switch 414. These occur in the following manner.

The lead 486 containing the normally open contacts 488 of the relay 468 has a lead 494 interconnected to the lead 484 to the coil **466*a* of the relay 468 and electrically connected to the timer 419. Across the lead 494 is another lead 496 containing the normally open down limit switch 404. Thus, retraction of the pressure plate is a function of the first to occur of running out of the timer 419, to effect closing of its internal normally open contacts, or mechanical closing of the down limit switch 404. In either event and, also, in the event of overriding by depression of the push button 414 to close the normally open contacts 482, the result is to energize the coil 466*a* of relay 468. Consequently, the relay armature is shifted to open the contacts 472, 488 thus effecting de-energization of the air valve control solenoid 226 and the pressure plate latch solenoid 318. In response to de-energization of the solenoid 226, switch 410 closes which switch 408 opens, so the air valve control is internally set to the mode shown in FIG. 13 to effect pressurization of the bin for retraction of the pressure plate. De-energization of the solenoid 318 of the pressure plate latch means 124 effects opening of the switch 406**.

The up limit switch 412 and switch 410 of the air valve control system are connected in series in a shunt lead 500 of the 486, around or paralleling the normally open contacts 488, now open pressure plate latch switch 406, and now open switch 408 in the lead 486. It will be recalled that the up limit switch 412 closed upon the pressure plate 18 initiating its downward movement during the compacting mode. The switch 410 of the air valve control having now been closed, the motor relay 449 remains energized, maintaining a closed condition of its contacts 450 and continued operation of the motor 244 to effect pressurization of the container with consequent retraction of the pressure plate 18.

As the packing blade 18 approaches its upper retracted position, the blade latch roller 292 engages the lower camming edge 290 of the cam plate 264 of the blade latch means 264, latch plate 262, and latch interlock member 300 of the blade latch means 124 occupy their latching and engaged or interlocking positions of FIG. 6. Engagement of the packing blade cam roller 292 with the cam plate edge 290 cams the cam plate 264 counterclockwise in FIG. 6 about its pivot 266 relative to the latch plate 262. This counterclockwise rotation of the cam plate urges a bevelled edge 492 of the plate against the interlock roller 312 to cam the interlock member 300 to its retracted position, This releases the latch plate 262 for counterclockwise rotation with the cam plate 264 when the lost motion, pin and slot connection 278, 280 between the plates reaches the end of its lost motion travel. When the packing blade 18 arrives in its fully retracted position, the blade latch and cam plates 262, 264 are returned to their latching positions of FIG. 6 under the blade latch roller 292 by the latch spring 268. The interlock member 302 is returned to its engaged position of FIG. 6 by the interlock spring 314. The packing blade 18 is thereby again latched in its retracted position with the latch plate interlock means 298 re-engaged to lock the latch means against release.

Arrival of the packing blade 18 in its retracted position reopens the blade up limit switch 412. This, in return, opens the energizing circuit for the relay 449 and stops the air pump motor 244 to complete one packing cycle of the refuse compactor.

It is now understood that the packing blade 18 is automatically driven through a refuse packing cycle each time the compactor cover 16 is closed and the cover key lock 386 is turned to lock position to remove the key. In this regard, it is significant to note that the key is removable from the lock only in this lock position of the key lock. Accordingly, removal of the key from the compactor requires rotation of the key lock to its locked position, wherein a packing cycle of the compactor is automatically triggered.

Referring now to FIG. 1, it will be apparent that for reliable, maintenance-free operation of the self-contained compactor container 10 it is important to maintain the integrity and reliability of the sealing means between the cover 16 and container 12, as well as the peripheral seal of the pressure plate 18 with respect to the interior walls of the container. For example, in a three yard container, dozens of lineal feet of seal means are involved, the failure of any portion of which would inhibit or prevent operation of the compactor. With this in mind attention is particularly directed to certain important features of the several seals involved.

It will be recalled that the pressure plate seals 98 and 104, along the rear and opposite end edges of the pressure plate 18, respectively, are of identical cross-sectional configuration. These seals have a pair of symetrical lips, e.g., the lips 106, 108 in FIG. 3, such that during lowering of the pressure plate 18 the lip 108 acts as a scraper in advance of the lip 106 which acts as an air seal in response to the negative internal pressure within the container. Then, upon retracting movement of the pressure plate 18, the lip 106 scrapes along the internal side walls of the container in advance of the other lip 108, which is then acting as a seal in response to the positive internal pressure within the container. In configuration, the lips 106 and 108 are similar to one species of pressure plate seal disclosed in my aforementioned U.S. Pat. No. 4,070,962. However, in the present invention, the base portion of the pressure plate seals 98, 104 have an improved configuration for mechanically effecting sealing along the base.

More particularly, the generally Y-shaped base 110, with its relatively sharply defined sealing edges 111*a*, is adapted to insure proper mounting of the seal during manufacture and during field maintenance, as well as to more effectively insure the defining of a reliable air seal during operation. Thus, referring to FIG. 3, as the pressure plate 18 is lowered to the extent that both flexible lips 106, 108 are sliding along the confronting container inner wall, the mechanical deflecting force reacts through the body of the material, which is preferably thermoset polyurethane, to slightly deepen the V-face 111 such that the sharp edges 111*a* are more firmly pressed into tight sealing engagement with the adjacent flange 78 of the pressure plate 18. The Y-shaped configuration of the base portion 110 is also adapted for clamping under the flanges of the members 114, 112 upon installation or replacement of a seal 104, 98.

Referring to FIG. 3, the rigid scraper bars 118 are secured along ends of the blade 18 below the end seals 104 to define a gap of about ¾ of an inch with the confronting end wall. A similar scraper bar is mounted along the rear edge of the blade but with a relatively narrow gap, say ¼ inch relative to the rear wall 88. These bars all scrape or deflect solid objects from the container surfaces in advance of the seals to further protect the seals. The different gaps of the bars 118 at the rear and ends of the pressure plate 18 are an important feature in protecting the corresponding seals.

More particularly, with respect to the rear seal 98, it will be recalled that it is so mounted along the rear edge of the packer plate 18 that when the cover 18 is open the lower lip 102 remains in contact with the reversely curved upper end portion of the rear container wall 88. At the same time, the rear scraper bar 118, with its relatively small gap relative to the rear wall 88, insures that none of the refuse can enter behind the raised pressure plate. The relatively small gap also insures that as the cover 16 is closed, and during downward compacting movement and upward retracting movement of the pressure plate 18, refuse cannot become lodged behind the pressure plate.

Referring now specifically to the pressure plate end seals 104, when the cover 16 is closed it is possible that some objects of refuse may be clamped between the cover 16 and container 12 at the opposite ends of the pressure plate 18. Then, when the pressure plate 18 is lowered to effect compaction, objects so clamped may not be removed by the side scraper bars 118 as the pressure plate 18 is lowered and would not be even if the side scraper bars 118 were relatively closed spaced to the side wall, like the rear scraper bar 118. However, the polyurethane material of the seals 104, by virtue of the flexible lips 106, 108, is well adapted to resiliently conform to the contours of objects over which they slide during descent of the pressure plate 18 and so maintain a sufficient seal to insure continued compacting movement. Then, upon raising of the pressure plate 18 to fully retracted position, the flexible lips 106, 108 sufficiently conform to the clamped refuse to maintain the seal under positive internal pressure in the container. At the same time, portions of the cover-clamped refuse may be deflected upwardly with and behind the rising pressure plate such that when it is in fully retracted position and the cover 16 is opened, refuse may then be clamped between either or both of the lips 106, 108 and the confronting surface 68 of the side wall of the cover 16. By virtue of the relatively large gap defined by the side scraper bars 118 relative to the confronting surface 68 such hanging items of refuse can easily be retrieved and safely deposited in the container so as to not inhibit continued use of the compactor.

The specific configuration of the cover side seals 72 is also of importance in insuring proper operation of the seal if refuse is clamped thereunder and under both negative and positive internal pressures within the closed container 10.

Referring to FIG. 3*a*, the relaxed cross-sectional configuration of a seal 72 is shown in solid outline and, in phantom outline, in the configuration assumed when the cover 16 is clamped onto the top flange 74 of the container side wall. The seal 72 is also made of a resilient thermoset polyurethane. Seal 72 has, along its top side, a generally rectangular base portion 722 with a flat face adatped to seal against the underside of the cross-member 70 of the double walled cover end flange. Along its outside an irregularly shaped median relief 724 is formed to receive the inturned flange 73 of a strip fastener 75 secured along the outer side wall 67 of the cover. The securing strip 75 is secured in place by spaced fasteners, as shown. The base portion 722 of the seal 72 is thus securely clamped against the cross wall 70 and against the inner wall 68 of the double wall cover end flange 16. The arrangement is such that a shoulder 726 of a median leg 725 is seated against the lower edge of the flange wall 68 so that the seal 72 is keyed in place.

The lower face of the seal 72 comprises one outwardly projecting leg 728 and another inwardly projecting leg 730, which merge into one another in a central relatively thick body portion 732. The thicker leg 730 underlines median leg 725, which has an inner face 732 that, in the indexed position of the seal, is substantially flush with the inner face of the flange wall 68.

The leg 730 is thicker than the outwardly projecting leg 728 and its inner end comprises a flat face 734 which, in the compressed state of the seal 72, will be substantially flush with the face 732 of median leg 725. The upper face of the thicker leg 730 also comprises a flat surface 736 which, in the relaxed state of the seal 72, defines an acute angle with the overlying face 738 of median leg 725. The surfaces 736 and 738 merge along the central body portion 732 of the seal in a groove configuration 740 adapted to define a hinge for flexing movement of the thicker leg 730.

As is best seen in FIG. 3, when the seal 72 is compressed, the leg 730 at its inner end having the flat face 730 is compressed against median leg 725. At the same time, the surfaces 736 and 738 define a gap which is divergent outwardly towards the hinge groove 740. At the same time, the outermost edge of the leg 728 has a flat bottom face forcefully biased against the top flange 74 of the container wall. This arrangement provides a very secure seal under conditions of positive internal pressure within the container by virtue of the gap between legs 725 and 730. Under conditions of negative internal pressure the other leg 728 provides a secure seal. At the same time, under conditions of both positive and negative internal pressure, the cross-sectional configuration of the seal 72 is adapted to conform to articles of refuse clamped thereunder sufficiently to maintain the seal for adequate operation in both directions of movement of the pressure plate 18.

I claim:

1. In a refuse compactor, the combination comprising:

a refuse container including a container body having relatively rigid side and bottom walls defining a refuse receiving space within the body, and further defining a top access opening to said refuse space, and a hinged cover swingable to and from closed position on top of said side walls to cover said top opening, and a refuse packing blade hinged to swing downwardly relative to said cover to an extended position within said refuse space when said cover is closed to compress refuse between said blade and a container body wall and to swing upwardly from said refuse space to a retracted position adjacent said cover, wherein said cover may be opened with concurrent lifting of said blade out of registration with said opening, said blade having a plan form and area to fully obturate said opening and said refuse space.

2. The subject matter of claim 1 wherein:

said container body has front, rear, and end walls, said cover and packing blade have front and rear edges, said cover is hinged along its rear edge to said container body along the upper edge of said rear wall, and said packing blade is hinged along one of said blade edges to the underside of said cover adjacent the corresponding cover edge.

3. The subject matter of claim 2 wherein:

the other of said packing blade edges is a free edge, and said blade has end edges extending between said front and rear blade edges, the other of said front and rear container walls is cylindrically curved about the hinge axis of said blade when said cover is closed, means for sealing said end and free blade edges to said end and curved container walls, respectively, and sealing the remaining blade edge to said container during extension and retraction of said blade into and from said refuse space with said cover closed, and means for sealing said cover to said opening of said container in said closed position of said cover.

4. The subject matter of claim 3 wherein:

said packing blade is hinged along its front edge to said cover adjacent the front cover edge, and said curved container wall is said rear wall.

5. The subject matter of claim 3 wherein:

said sealing means along each packing blade end and free edge comprises a resilient wiping flange and a resilient sealing flange extending along the respective blade edge for resilient contact with the adjacent container side wall during extension and retraction of said blade, each seal wiping flange leads its respective sealing flange relative to the direction of extension movement of said blade, and each sealing flange is out of deflecting contact with its respective container side wall in the retracted position of said blade.

6. The combination of claim 5 wherein:

the sealing means along each packing blade end and free edge comprises a resilient sealing element whose sealing and wiping flanges diverge toward their outer container side wall engaging edges.

7. A refuse compactor comprising:

a refuse container including a container body having relatively rigid side and bottom walls defining a refuse receiving space within said body and a top access opening to said refuse space, and a hinged cover swingable to and from closed and sealed position relative to said top opening, a packing blade hinged to swing downwardly relative to said cover and slidably over internal surfaces of said walls to an extended position within said refuse space when said cover is closed to compress refuse between said blade and a container body wall and to swing upwardly from said space to a retracted position adjacent said cover wherein said cover may be opened with concurrent lifting of said blade out of said opening, said blade having a plan form and area to fully obturate said opening and said refuse space, and operating means for effecting extension and retraction of said blade in obturating relationship to said refuse space.

8. The subject matter of claim 7 wherein:

said operating means comprises means for creating pressure forces on said packing blade to extend and retract the blade.

9. The subject matter of claim 8 including:
cover latch means for latching said cover in closed position, and
latch means for nonreleasably latching said packing blade in retracted position except when said cover is latched closed.

10. The subject matter of claim 9 wherein:
said packing blade latch means comprises a spring loaded latch member for latching said blade in retracted position in a manner such that when subjected to a pressure force in a direction to extend the blade, the latter exerts a force on said latch member in a direction to retract the latter against spring action to a position wherein the blade is released for extension, and a retractable interlock member engagable with said latch member to prevent retraction of said latch member by said packing blade except when said cover is latched closed.

11. The subject matter of claim 10 including:
a key lock for locking said cover in closed position, and electrical control means actuated by said key lock for retracting said interlock member to release said latch member for retraction by said packing blade only when said cover is locked in closed position.

12. The subject matter of claim 11 wherein:
said key lock is rotatable by a key between locked and unlocked positions only when said cover latch means occupies its latched position,
said key lock includes means for locking said cover latch means in latched position when said key lock occupies said locked position, and
said control means comprises an electrical actuator for retracting said interlock member, and an electrical circuit including switches operable by said key lock and said cover, respectively, for effecting operation of said actuator to retract said interlock member only when said cover is closed and said key lock is in locked position.

13. The subject matter of claim 12 wherein:
said container body has front, rear, and end side walls,
said cover and packing blade have front and rear edges,
said cover is hinged along its rear edge to said container body along the upper edge of said rear wall,
said packing blade is hinged along one of said blade edges to the underside of said cover adjacent the corresponding cover edge,
the other of said blade edges is a free edge, and said blade has end edges extending between said front and rear blade edges,
the other of said front and rear container walls is cylindrically curved about the hinge axis of said blade when said cover is closed, and
means for sealing said end and free blade edges to said end and curved container walls, respectively, and sealing the remaining blade edge to said container during extension and retraction of said blade into and from said refuse space with said cover closed.

14. The subject matter of claim 13 wherein:
said operating means comprises means for evacuating said refuse space to effect downward extension of said packing blade through said space by atmospheric pressure and gravity and pressurizing said refuse space to effect upward retraction of said blade from the space by air pressure.

15. The subject matter of claim 7 wherein:
said container body has front, rear, and end walls,
said cover and packing blade have front and rear edges,
said cover is hinged along its rear edge to said container body along the upper edge of said rear wall,
said blade is hinged along one of said blade edges to the underside of said cover adjacent the corresponding cover edge,
the other of said blade edges is a free edge, and said blade has end edges extending between said front and rear blade edges,
the other of said front and rear container walls is cylindrically curved about the hinge axis of said blade when said cover is closed, and
means for sealing said end and free blade edges to said end and curved container walls, respectively, and sealing the remaining blade edge to said container during extension and retraction of said blade into and from said refuse space with said cover closed.

16. The subject matter of claim 15 wherein:
said packing blade is hinged along its front edge to said cover adjacent the front cover edge, and
said curved container wall is said rear wall.

17. The subject matter of claim 7 wherein:
said operating means comprises means for evacuating said refuse space to effect downward extension of said packing blade through said space by atmospheric pressure and gravity and pressurizing said refuse space to effect upward retraction of said blade from the space by air pressure.

18. A refuse compactor comprising:
a refuse container including a container body having an interior refuse receiving space, a top access opening to said space, and a cover for closing said opening,
means for locking said cover closed,
a refuse packing blade within said container having a normal retracted position within said cover when said cover is open, and said blade being movable through a refuse packing cycle from said retracted position through said refuse space and back to said retracted position to compress refuse in said space,
operating means operable in response to locking of said cover in closed position for effecting movement of said blade through a refuse packing cycle, and
latch means for non-releasably latching said packing blade in retracted position except when said cover is latched closed.

19. The subject matter of claim 18 wherein:
said packing blade is hinged to said cover to swing downwardly through an extension stroke into said refuse space to compress refuse in said space and swing upwardly through a return stroke to a retracted position adjacent the cover.

20. The subject matter of claim 19 wherein:
said operating means comprises means for evacuating said refuse space to effect downward extension of said blade through said refuse space and pressurizing said refuse space to effect upward retraction of said blade from said space, and control means for controlling said operating means to effect a refuse packing cycle of said blade in response to locking of said cover in closed position.

21. The subject matter of claim 20 wherein:
said operating means comprises an air pump having an air intake port, and air exhaust port, valve means operable between two positions for selectively communicating either port to said refuse space and the other port to atmosphere, and said control means comprises switch means responsive to the position of said blade, switch means responsive to the position of said valve means, switch means operable by said cover, switch means operable by said cover lock means, means for actuating said valve means between said valve positions, and circuit means including said switch means and actuating means for effecting each refuse packing cycle of said blade in response to locking of said cover in closed position.

22. The subject matter of claim 21 wherein:

said container body has front, rear, and end side walls, said cover and packing blade have front and rear edges, said cover is hinged along its rear edge to said container body along the upper edge of said rear wall, said packing blade is hinged along one of said blade edges to the underside of said cover adjacent the corresponding cover edge, the other of said blade edges is a free edge, and said blade has end edges extending between said front and rear blade edges, the other of said front and rear container walls is cylindrically curved about the hinge axis of said blade when said cover is closed, and means for sealing said end and free blade edges to said end and curved container walls, respectively, and sealing the remaining blade edge to said container during extension and retraction of said blade into and from said refuse space with said cover closed.

23. The subject matter of claim 22 wherein:

said operating means comprises means for evacuating said refuse space to effect downward extension of said packing blade through said space by atmospheric pressure and gravity and pressurizing said refuse space to effect upward retraction of said blade from the space by air pressure.

24. A refuse compactor comprising:

a refuse container including a container body having an interior refuse receiving space, an access opening to said space, and a cover for closing said opening, a packing blade within said container having a normal retracted position wherein said compactor is conditioned to receive refuse in said refuse space when said cover is opened, and said blade being movable through a refuse packing cycle involving extension of said blade from said retracted position through a packing stroke to compress refuse in said refuse space and following retraction of said blade through a return stroke back to said retracted position, blade operating means including an air pump and a valve for selectively evacuating and pressurizing said refuse space to effect movement of said blade through a packing cycle, and said valve including valve members which control airflow to and from said refuse space and open in the direction of airflow past the respective valve members, whereby air pressure differential across each valve member when closed acts to open the valve member, and valve operating means for selectively retaining each valve member closed against the force of said pressure differential and releasing the valve member for opening by said force.

25. The subject matter of claim 24 wherein:

said pump has an intake port and an exhaust port, and said valve is operable to selectively communicate either port to said refuse space and the other port to atmosphere, whereby said blade is movable through said packing stroke by atmospheric pressure and through said return stroke by air pressure in said refuse space.

26. The subject matter of claim 25 wherein:

said container body has a top opening and said blade is hinged to said compactor cover, whereby said blade swings downwardly through said packing stroke and upwardly through said return stroke.

27. The subject matter of claim 24 wherein:

said valve members are hinged valve flappers having downstream sides relative to the direction of airflow past the respective flappers, and said valve operating means comprise cam-like means engagable with said downstream flapper sides for moving said valve flappers towards closed positions.

28. The subject matter of claim 27 wherein:

said cam-like means comprise rotary shafts at the downstream sides of said valve flappers, respectively, mounting radially projecting cam-like elements rotatable with said shafts into and from engagement with their respective flappers.

29. In a refuse compactor the combination comprising:

a refuse container including a container body having relatively rigid side walls defining a refuse receiving space within the body and further defining a top access opening to said refuse space;

a cover mounted on said body that is swingable to and from a closed position on top of said walls to cover said top opening;

refuse packing blade means hinged to swing downwardly relative to said cover to an extended position within said refuse space when said cover is closed to compress refuse between said blade and a container body wall and to swing upwardly from said space to a retracted position adjacent said cover wherein said cover may be opened with concurrent lifting of said blade out of said opening, said refuse packing blade means having a planform and area to fully obturate said opening, cover seal means for air sealing said top access opening when said cover is in said closed position, and packing blade seal means on the periphery of said packing blade means, a portion of said packing blade seal means comprising a portion of said cover seal means along a hinge of said cover when said packing blade means is in said retracted position.

30. The subject matter of claim 29 wherein:

said cover is hingedly connected to a rear wall of said container, said packing blade means is hingedly connected to the underside of a front edge of said cover, and said rear wall of said container is cylindrically curved about the hinge area of said packing blade means to to be slidably engaged by said portion of said packing blade seal means during swinging movement of said packing blade means in said refuse space.

31. The subject matter of claim 30 wherein:

the upper rear edge of said rear wall is reversely cylindrically curved about the hinge axis of said cover to be in slidable contact with said portion of said packing blade means in swinging movement of said cover to and from said access opening.

32. The subject matter of claim 31 wherein:

a rigid scraper bar is affixed along the rear edge of said packing blade means and under said portion of said packing blade means with a relatively small gap spacing relative to said rear wall and to said reversely curved upper rear edge of said rear wall.

33. The subject matter of claim 31 wherein:

said packing blade means has opposite ends extending radially from the hinge of said packing blade means, and a rigid scraper bar is affixed to the underside of said packing blade means under said packing blade seal means at each of said opposite ends with a relatively large gap spacing relative to opposite end walls of said container and to opposite end walls of said cover.

34. The subject matter of claim 29 wherein:

said packing blade seal means comprises an elastomeric air seal of the type having a symetrically arranged pair of oppositely extending lip seals and a generally Y-shaped base portion having a shallow V base surface defining a parallel pair of sharp edges for sealing against a flat surface of said refuse packing blade means.

35. The subject matter of claim 29 wherein:

said cover seal means comprises an elongate strip of resilient material having uniform cross-section, said cross-section in relaxed condition comprising, a base portion on one side of said strip, a pair of oppositely laterally extending and angularly related legs constituting the other side of said strip, and a median leg between one of said laterally extending legs and said base portion having a terminal edge that is closable upon a terminal edge of said one leg when said seal strip is compressed.

36. The subject matter of claim 35 wherein:

a hinge means is defined at the root of said one of said laterally extending legs, said one of said laterally extending legs and said median leg having confronting surfaces that define an inwardly divergent space therebetween when said seal strip is compressed.

37. The subject matter of claim 35 wherein:

said terminal edges have shape characteristics to together define a flat coplanar surface when said seal strip is under compression.

* * * * *